US005500669A

United States Patent [19]

Yamashita et al.

[11] Patent Number: 5,500,669

[45] Date of Patent: Mar. 19, 1996

[54] LABEL CREATION CASSETTE

[75] Inventors: Akio Yamashita, Takizawa; Kazutaka Suzuki, Tamayama; Toshiaki Amano; Kazuhiko Hatakeyama, both of Morioka, all of Japan

[73] Assignee: Alps Electric Co., Ltd., Tokyo, Japan

[21] Appl. No.: 115,401

[22] Filed: Sep. 1, 1993

[30] Foreign Application Priority Data

| | | | |
|---|---|---|---|
| Sep. 11, 1992 | [JP] | Japan | 4-269787 |
| Mar. 30, 1993 | [JP] | Japan | 5-093836 |
| Jul. 1, 1993 | [JP] | Japan | 5-188999 |

[51] Int. Cl.[6] ..... B41J 32/00

[52] U.S. Cl. ..... 347/214; 400/208

[58] Field of Search ..... 347/214; 400/207, 400/208, 208.1

[56] References Cited

U.S. PATENT DOCUMENTS 5,188,469 2/1993 Nagao et al. ..... 400/208

5,209,151 5/1993 Takagi et al. .

FOREIGN PATENT DOCUMENTS

0327076A2 8/1989 European Pat. Off. .

0487314A1 11/1991 European Pat. Off. .

0489717A2 6/1992 European Pat. Off. .

*Primary Examiner*—Huan H. Tran

*Attorney, Agent, or Firm*—Guy W. Shoup; Patrick T. Bever

[57] ABSTRACT

The present invention relates to a label creation cassette capable of creating a label when mounted on a thermal printer used as an output unit for personal computers and wordprocessors.

A cassette case 1 with a substantially rectangular surface includes substantially cylindrical cores 2*a*, 2*b*, 2*c* each rotatably supported therein. An image transfer tape 3 is wound around the core 2*a* of these three cores. Further, a thermal transfer ink ribbon 4 is wound around one of the remaining two cores or the core 2*b* and the other core 2*c* is used to wind the ink ribbon 4.

8 Claims, 27 Drawing Sheets

LABEL CREATION CASSETTE

BACKGROUND OF THE INVENTION

1. Field of the Invention

The present invention relates to a label creation cassette for creating a label, and more specifically, to a label creation cassette used for executing a print operation to a tape by a thermal transfer system, thermo-sensitive system or the like.

2. Description of the Related Art

There is conventionally proposed a label printer and an ink ribbon cassette for the label printer. The label printer can create a label by printing a desired image information on a label coated with adhesive and the thus created label is bonded on the back cover of a file, used as the index of an audio or video cassette, or bonded on articles to show the name of their owner.

Nevertheless, this kind of the label printer has a problem in that it is dedicated for the creation of label and has no application other than label printing, and thus it does not have versatility.

SUMMARY OF THE INVENTION

An object of the present invention made to solve the above problems is to provide a label creating cassette capable of simply creating a label by being mounted on a thermal transfer printer or the like usually used as an output unit of a wordprocessor or personal computer.

Another object of the present invention is to provide a label creating cassette having a guide unit for guiding a label tape in a direction apart from the platen of a thermal printer, the guide unit being located on the downstream side of a print unit, where a print operation is executed to the label tape by the thermal energy of a thermal head, in the direction toward which the label tape is fed.

A further object of the preset invention is to provide a label creating cassette having an accommodation unit for accommodating at least a portion of a label tape to which a print operation has been executed by the thermal energy of a thermal head.

A still further object of the preset invention is to provide a label creating cassette having a curl correction unit located on the upstream side of a print unit, where a print operation is executed to the label tape by the thermal energy of a thermal tape, in the direction toward which the label tape is fed for preventing the curing of the label tape.

A still further object of the present invention is to provide a label creating cassette in which a portion of the label creating cassette is located nearer to the platen side of a thermal printer than the inside surface of a paper guide provide with the carriage of a thermal printer on which the cassette is mounted.

A still further object of the present invention is to provide a label creating cassette having a guide unit for guiding the width direction of a label tape on the downstream side of a print unit, where printing is executed to the label tape by the thermal energy of a thermal tape, in the direction toward which the label tape is fed, on the side where a cassette case confronts with the platen of a thermal printer.

A still further object of the present invention is to provide a label creating cassette including a load application means for applying a predetermined load to the core on the side where the thermal transfer ribbon accommodated in a cassette case is supplied.

A still further object of the present invention is to provide a label creating cassette including a winding disturbance prevention member for preventing the winding disturbance of a label tape provided with a label tape supply core for supplying the label tape accommodated in a cassette case.

A still further object of the present invention is to provide a label creating cassette wherein the feed path of an image transfer tape accommodated in a cassette case is linearly arranged from a supply core to a print unit at least at the initial state of an ink ribbon cassette.

A still further object of the present invention is to provide a label creating cassette wherein the feed path of a label tape accommodated in a cassette case from a supply core to a print unit is formed to a substantially smooth curved shape with a projection directed toward only one side thereof.

A still further object of the present invention is to provide a label creating cassette wherein a guide unit for guiding a label tape toward a direction apart from the platen of a thermal transfer printer, the guide unit being located on the downstream side of a print unit, where a print operation is executed to the label tape by the thermal energy of a thermal head, in the direction toward which the label tape is fed and further on the downstream side of an opening formed to accommodate an ink ribbon having being used for a print operation in a case.

A still further object of the present invention is to provide a label creating cassette wherein a rewind prevention member is located on the upstream side of a print unit, where a print operation is executed to the label tape by the thermal energy of a thermal head, in the direction toward which the label tape is fed to prevent the image transfer tape to return to a reverse direction.

A still further object of the present invention is to provide a label creating cassette provide with a first opening for taking out a label tape accommodated in the case of a cassette to the outside of the cassette and a second opening for taking out an ink ribbon accommodated in the cassette to the outside of the cassette, respectively.

According to the label creation cassette of the present invention, the label tape to which a print operation has been completed at the print unit is guided toward a direction apart from the platen by the guide member disposed on the downstream side of the direction toward which the tape is fed.

Further, according to the label creation cassette of the present invention, when a print processing is executed by the label creation cassette mounted on a thermal printer such as a thermal transfer printer or the like, a thermal head executes a usual print operation by generating heat. At this time, however, since the ink ribbon and label tape are disposed between the thermal head and a platen in an overlapped state, the ink of the ink ribbon is transferred onto the label tape in such a manner that the thermal head generates heat in response to a print command signal while pressing the ink ribbon and label tape against the platen. More specifically, a desired image is printed onto the label tape by being thermally transferred onto the label tape. Then, while the thermal head executes the heat generating print operation as described above, the ink ribbon and the label tape are taken out from an ink ribbon winding unit and label tape winding unit, respectively, by the force by which they are held between the thermal head and the platen as the carriage is moved. Then, the ink ribbon having passed between the thermal head and the platen is wound around an ink ribbon winding unit and the label tape having passed therethrough and to which the print operation has been completed is guided by the guide member toward a direction apart from the platen. Then, the label tape to which the print operation has been completed can be used as a label by being cut off to a necessary length. Further, since the label tape to which the print operation has been completed is guided by the guide member toward the direction apart from the platen, the label tape to which the print operation has been completed is held between the carriage and the platen by the reciprocating motion of the carriage executed together with the print operation, and thus there is no possibility that the label tape is made dirty or damaged.

Further, according to the label creation cassette of the present invention, since the label tape to which the print operation has been completed can be stored in the case of the ink ribbon cassette by a predetermined length (e.g., several tens of characters), there is no possibility that the label tape to which the print operation has been completed is made dirty or damaged by being held between the carriage and the platen by the reciprocating motion of the carriage executed together with a print operation.

Further, according to the label creation cassette of the present invention, the label tape to which the print operation has been completed is smoothly guided to the accommodation unit.

Further, according to the label creation cassette of the present invention, the label tape to which the print operation has been completed is held at the front end thereof as well as the label tape to which the print operation has been completed is securely stored in the accommodation unit in a predetermined shape.

Further, according to the label creation cassette of the present invention, the front end of the label tape to which the print operation has been completed is smoothly guided to the holding unit.

Further, according to the label creation cassette of the present invention, the label tape to which the print operation has been completed is accommodated in the accommodation unit as well as the label tape which cannot be accommodated therein is promptly taken out to the outside of the case while being curved.

Further, according to the label creation cassette of the present invention, scissors can be inserted through the second opening formed to the upper surface of the cassette and the label tape to which the print operation has been completed can be easily cut off by the scissors.

Further, according to the label creation cassette of the present invention, even if the cassette is not used for a long time, the ink ribbon is not adhered to the label tape.

Further, according to the label creation cassette of the present invention, since the property of the label tape tending to be curved is corrected, the label tape stably travels.

Further, according to the label creation cassette of the present invention, the cassette is smoothly mounted on the carriage of the thermal printer. Further, when a print operation is executed, the label tape is securely pressed against the platen by the thermal head, and thus the label tape can be securely taken out from the ink ribbon cassette case.

Further, according to the label creation cassette of the present invention, when the cassette is mounted on the carriage of the thermal printer, there is a no possibility that the ink ribbon is caught by the thermal head and the like and wrinkles are produced to the ink ribbon, and thus the cassette can be smoothly mounted. Further, when a print operation is executed, the label tape is securely pressed against the platen by the thermal head, and thus the label tape is securely taken out from the cassette case.

Further, according to the label creation cassette of the present invention, the cassette is smoothly mounted on the carriage of the thermal printer without the possibility that the ink ribbon is caught by the thermal head or the like and wrinkles are produced. Further, when a print operation is executed, the label tape is securely pressed against the platen by the thermal head, and thus the label tape layer is securely taken out from the cassette case.

Further, according to the label creation cassette of the present invention, the cassette is smoothly mounted on the carriage of the thermal printer. Further, when a print operation is executed, the label tape is securely pressed against the platen by the thermal head, and thus the label tape provided with the thermo-sensitive recording layer is securely taken out from the cassette case.

Further, according to the label creation cassette of the present invention, the label tape to which the print operation has been completed is guided by the width direction guide member with respect to the width direction thereof and transferred without moving obliquely.

Further, according to the label creation cassette of the present invention, the thermal transfer ink ribbon supply core accommodated in the case of the cassette is always applied with a predetermined load and thus the ink ribbon is transferred without irregularly moving in the width direction thereof.

Further, according to the label creation cassette of the present invention, a winding disturbance is not caused to the label tape accommodated in the case of the cassette.

Further, according to the label creation cassette of the present invention, when the cassette is mounted on the carriage of the thermal printer, there is no possibility that the label tape is caught by the thermal head or the like, and thus the cassette can be smoothly mounted on the carriage.

Further, according to the label creation cassette of the present invention, a load for drawing out the label tape is reduced when a print operation is executed.

Further, according to the label creation cassette of the present invention, since the guide unit is disposed on the further downstream side of the opening disposed to accommodate the ink ribbon having used for a print operation in the case so that the label tape is guided in a direction apart from the platen of the thermal transfer printer, the label tape is caused to be apart from the platen at an obtuse angle.

Further, according to the label creation cassette of the present invention, the inconvenience that the label tape is rewound and enters into the cassette can be avoided by the provision of the rewind prevention means.

DESCRIPTION OF THE PREFERRED EMBODIMENTS

Embodiments of the present invention will be described below with reference to drawings.

Figure 1:
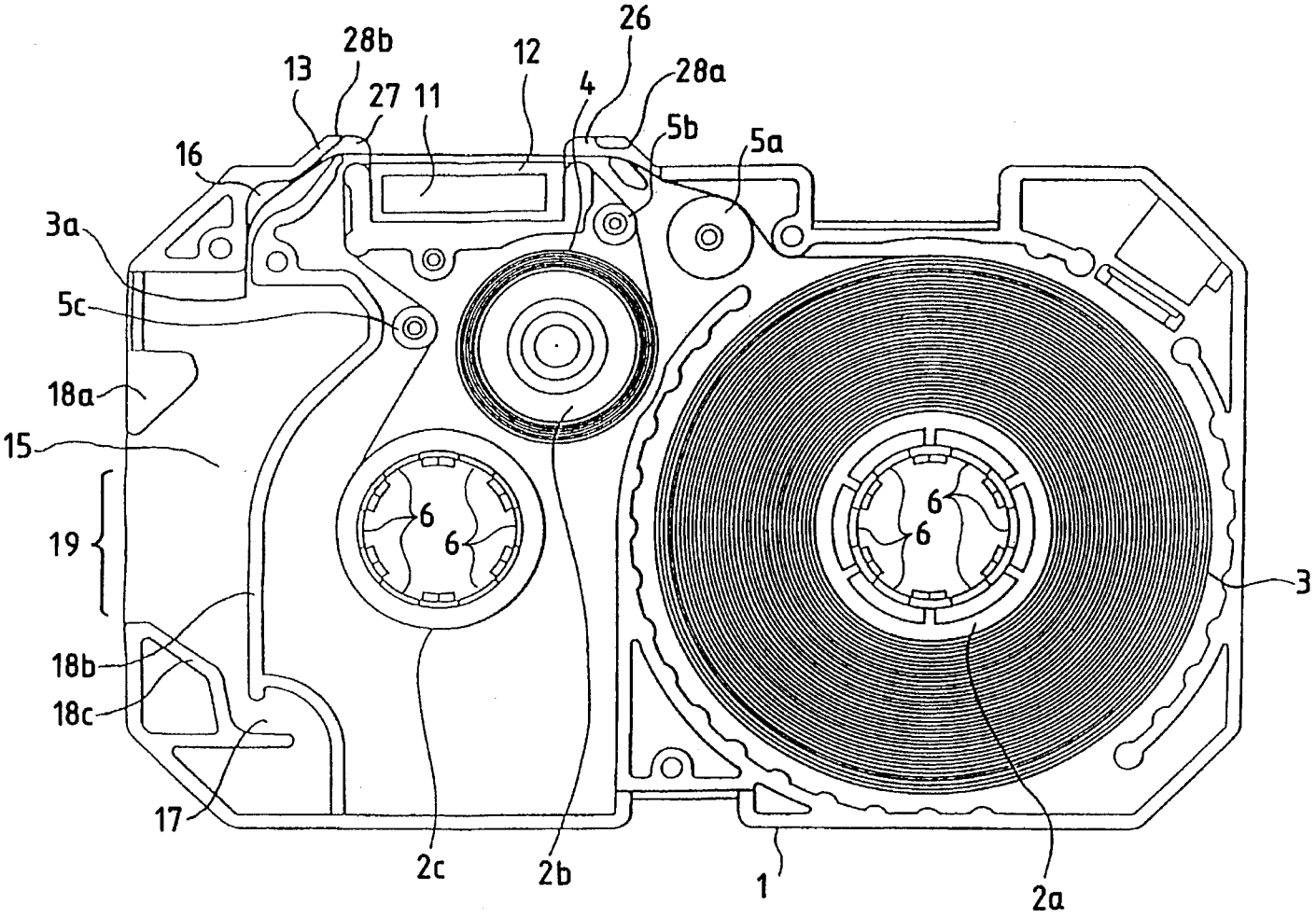
FIG. 1 is a plan view showing the main portion of a first embodiment of a label creation cassette of the present invention.
Figure 2:
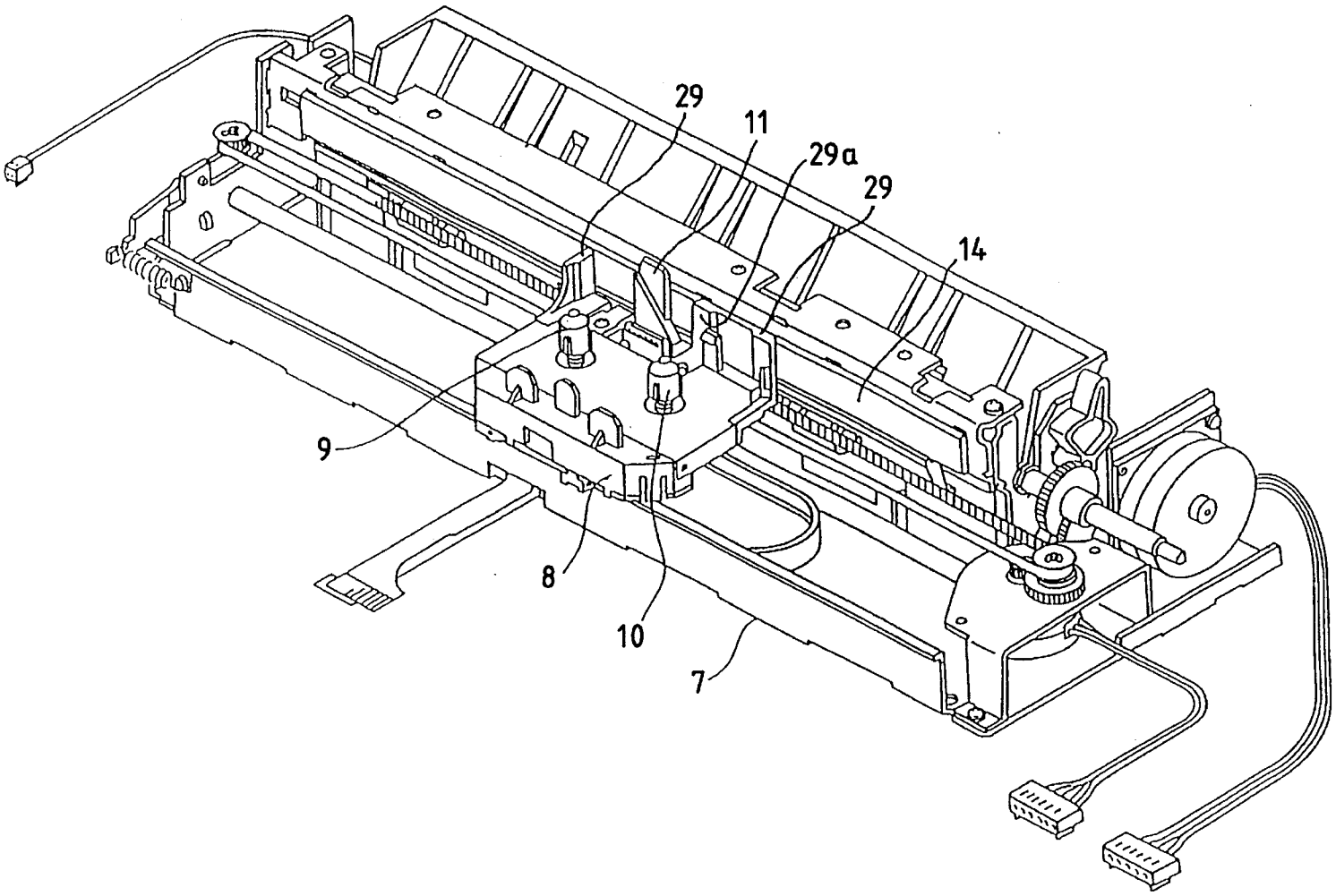
FIG. 2 is a diagram showing the arrangement of a printer on which the label creation cassette of the present invention is mounted.

FIG. 1 is a plan view showing the main portion of a first embodiment of a label creation cassette of the present invention, and FIG. 2 is an overall perspective view showing an example of a thermal transfer printer as a thermal printer for executing a print operation to a usual paper by a usual ink ribbon mounted thereon as well as capable of executing a print operation to a label tape when a label creation cassette of the present invention is mounted thereon.

As shown in FIG. 1, the label creation cassette of the present invention has substantially cylindrical cores 2*a*, 2*b*, 2*c* disposed in a cassette case 1 with a substantially rectangular surface and rotatably supported therein. An image transfer tape 3 as a label tape to which characters, images and the like are to be thermally transferred is wound around the core 2*a* of the three cores, a thermal transfer ink ribbon 4 is wound around one of the remaining two cores or the core 2*b*, and the other core of them or the core 2*c* is disposed to wind the thermal transfer ink ribbon 4. The image transfer tape 3 has three layers composed of a release paper, adhesive portion and a print portion. Guide roller 5a, 5b and 5c each supported rotatably are disposed along the feed paths of the ink ribbon 4 and the image transfer tape 3.

A plurality of keyways 6 are formed to a spline shape with intervals in a peripheral direction on the inner periphery of the core 2a around which the image transfer tape 3 is wound and the inner periphery of the core 2c disposed to wind the ink ribbon 4, respectively. The inner periphery of the core 2c disposed on the left side in the figure to wind the ink ribbon 4 and the inner periphery of the core 2a disposed on the right side in the figure around which the image transfer tape 3 is wound are arranged to be engaged with a winding bobbin 9 and a feed bobbin 10 projectingly disposed on the carriage 8 of a thermal transfer printer 7, respectively, as shown in FIG. 2.

Further, a recessed portion 12 is formed to the cassette case 1 to dispose therein a thermal head 11 as a print head mounted on the carriage 8 of the thermal transfer printer 7, and the intermediate portions of the ink ribbon 4 and image transfer tape 3 are taken out from the ribbon cassette case in this recessed portion 12. The image transfer tape 3 fed from the core 2a around which it is wound is taken out once to the outside of the ribbon cassette case 1 from the opening 26 of the recessed portion 12 through the guide roller 5a and then introduced again into the ribbon cassette case from the opening 27 of the recessed portion 12.

On the other hand, the ink ribbon 4 fed from the core 2b around which it is wound is taken out once to the outside of the ribbon cassette case 1 from the opening 26 of the recessed portion 12 through the guide roller 5b and then introduced again into the ribbon cassette case from the opening 27 of the recessed portion 12 and wound around the core 2c through the guide roller 5c.

The image transfer tape 3 and ink ribbon 4 are disposed between the platen 14 and thermal head 11 of the thermal transfer printer 7 between the opening 26 and 27 of the recessed portion 12 so that they can be overlapped to each other, and at this position the ink of the ink ribbon 4 is thermally transferred onto the image transfer tape 3 by the thermal head 11, that is, a so-called print operation is executed.

Further, a guide portion 13 is formed in the vicinity of the opening 27 of the recessed portion 12 of the cassette case 1 to guide the image transfer tape 3 introduced into the cassette case 1 from the opening 27, and a guide path 16 and an accommodation unit 15 for accommodating the image transfer tape 3 to which a print operation has been completed are disposed on the downstream side in the direction toward which the image transfer tape is transferred. Further, a stepwise-shaped holding unit 17 is formed on the further downstream side of the accommodation unit 15 to hold the front end 3a of the image transfer tape 3 accommodated in the accommodation unit 15.

The accommodation unit 15 is composed of a space surrounded by guide members 18a, 18b and 18c, and the front end 3a of the image transfer tape 3 introduced into the accommodation unit 15 is introduced to the holding unit 17 by being guided by the guide members 18a, 18b and 18c as described below.

Further, a first opening 19 is formed on the side of the accommodation unit 15, and the image transfer tape 3 which cannot be accommodated in the accommodation unit 15 as the print operation proceeds is curved and taken out to the outside of the cassette case 1 through the first opening 19.

Further, as described below, the side surface of the cassette case 1 which is in the vicinity of the recessed portion 12 and confronts with the platen 14 of the thermal transfer printer on which the ink ribbon cassette is mounted is composed of projections 28a, 28b projecting toward the platen 14 side and the projecting portion 28a, 28b are located nearer to the platen 14 side than the inner surface 29a of a paper guide 29 provided with the carriage 8 of the thermal transfer printer 7 shown in FIG. 2.

This arrangement is employed for the purpose of improving workability when the ink ribbon cassette is mounted on the carriage 8 and stably drawing out the image transfer tape 3 in a print operation. More specifically, since the thermal transfer printer with which the label creation cassette of the present invention is used originally has a main purpose of executing a print operation to a usual paper, an ink ribbon cassette for smoothly executing the print operation to the usual paper is arranged such that the case of the ink ribbon cassette does not more project to the platen side than the paper guide provided with the carriage so that a paper can be smoothly inserted onto the platen. With this arrangement, when the paper is inserted onto the platen, the front end of the paper is not caught by the cassette case.

Further, the platen itself is composed of a rubber member having a high degree of hardness to realize printing of high quality.

As a result, when the label creation cassette is composed of a cassette case having the same arrangement as that of a usual ink ribbon cassette, the image transfer tape itself has a bad bending property (the ink ribbon has a thickness of 5–8 microns whereas the image transfer tape for label has a thickness of 0.1–0.2 mm which is at least 20 times thicker than the ink ribbon and thus the bending property of the image transfer tape is much worse that of the ink ribbon). Thus, when this cassette is mounted on a carriage and the label creation cassette is abutted against the thermal head, the label creation cassette is bent and cannot escape from the thermal head, and thus the ink ribbon located between the image transfer tape and a thermal head is caught by the thermal head and wrinkled.

Further, since the bending property of the image transfer tape is worse than that of a usual paper in addition to that the image transfer tape has a lower friction with the platen as compared with the usual paper, when there is a long distance from the vicinity of the drawing-out port of the cassette case to the platen, the image transfer tape is not sufficiently pressed against the platen due to the bending of the image transfer tape 3 itself while it passes therebetween, and thus a slip may be arisen between the platen and the image transfer tape.

On the other hand, when the distance from the image transfer tape 3 taken out to the outside of the cassette case 1 to the platen 14 is shortened by forming the projections 28a, 28b projecting on the platen 14 side to the portion near to the recessed portion 12 of the cassette case 1 as in this embodiment, the cassette can be smoothly mounted on the carriage 8 without producing wrinkles to the ink ribbon as well as no slip is caused between the platen and the image transfer tape even if a pressure under which the thermal head is pressed against the platen is suitably set to execute a print operation to the usual paper, and thus the image transfer tape 3 can be smoothly drawn out from the cassette case 1.

Next, the state in which a print operation is executed to the image transfer tape 3 by using the label creation cassette of this embodiment will be described with reference to FIG. 3 to FIG. 16.

Figure 3:
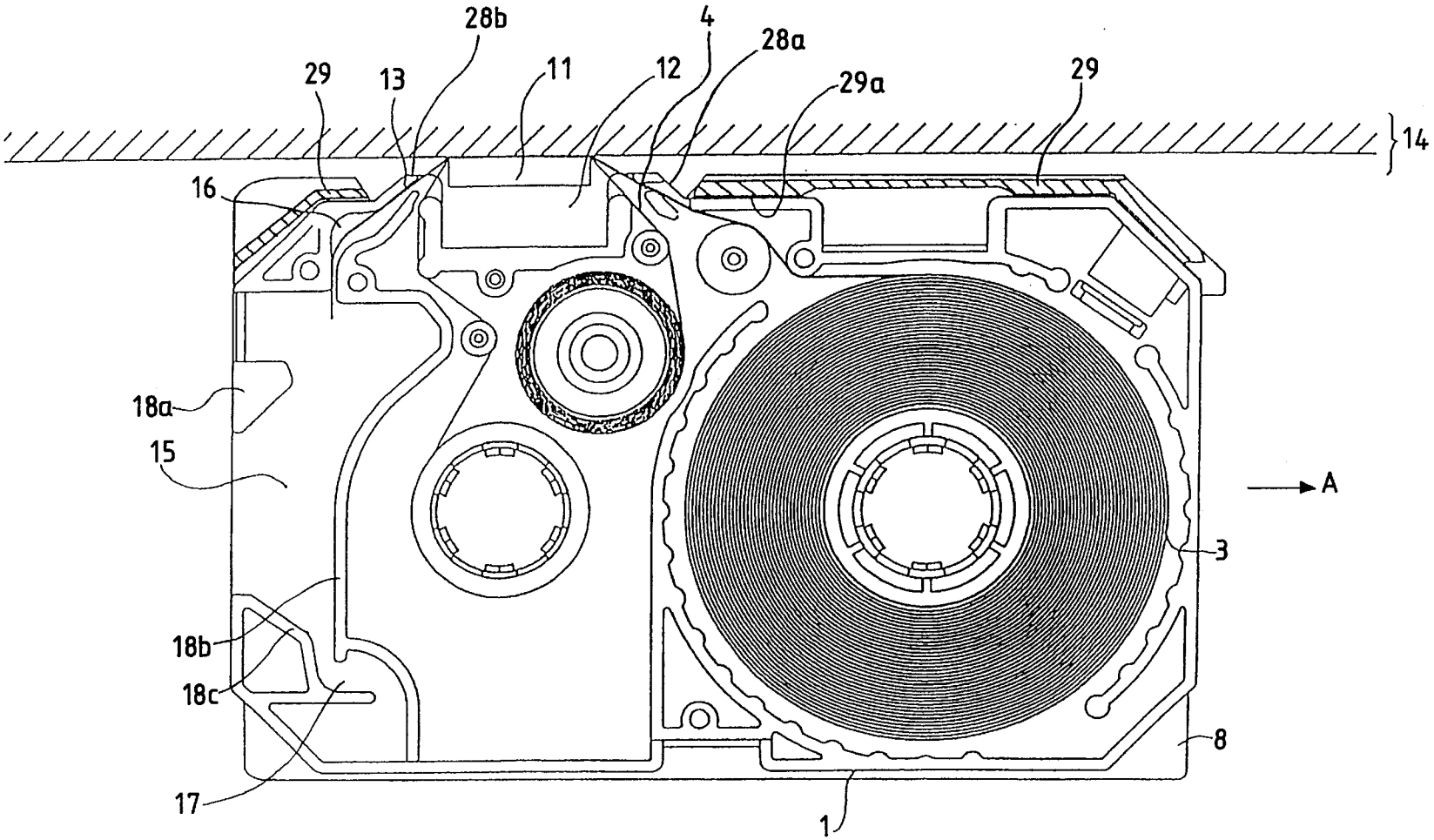
FIG. 3 is a diagram showing the state in which a print operation is executed by mounting the label creation cassette shown in FIG. 1 on the carriage of a thermal transfer printer.

FIG. 3 shows the state in which a print operation is started by mounting the label creation cassette of this embodiment on the carriage 8 of the thermal transfer printer 7. As shown in FIG. 3, the projections 28*a*, 28*b* of the cassette case 1 are located nearer to the platen 14 side than the inner surface 29*a* of the paper guide 29 provided with the carriage 8, and the formation of the projections 28*a* and 28*b* of the cassette case 1 to achieve this positional relationship enables the label creation cassette to be smoothly and securely mounted on the carriage without causing wrinkles to the ink ribbon which would be produced when it was caught by the thermal head 11. Further, since the distance from the image transfer tape 3 to the platen 14 is shortened, the image transfer tape 3 is securely pressed against the platen 14 by the thermal head 11 when the print operation is executed so that the image transfer tape 3 can be securely drawn out from the cassette case 1.

When the print operation is started, the image transfer tape 3 and ink ribbon 4 overlapped to each other are pressed against the platen 14 by the thermal head 11, and the ink of the ink ribbon 4 is transferred to the image transfer tape 3 by the thermal energy of the thermal head 11 by energizing the thermal head 11 while the carriage is moved in the direction shown by the arrow A in the Figure.

The image transfer tape 3 to which the ink has been transferred is introduced into the accommodation unit 15 in the cassette case 1 through the guide path 16 by being guided by the guide portion 13 disposed in the vicinity of the recessed portion 12 in which the thermal head 11 of the cassette case 1 is disposed toward a direction apart from the platen 14, and thus the image transfer tape 3 to which the print operation has been completed can be simply and securely collected without being held between the platen 14 and the carriage 8.

FIG. 4 to FIG. 9 sequentially shows the state that the print operation proceeds from the state shown in FIG. 3 and the image transfer tape 3 to which the print operation has been completed is transferred and accommodated into the accommodation unit 15. Note, in FIG. 4 to FIG. 9, the carriage 8 of the printer on which the label creation cassette is mounted is not shown.

Figure 4:
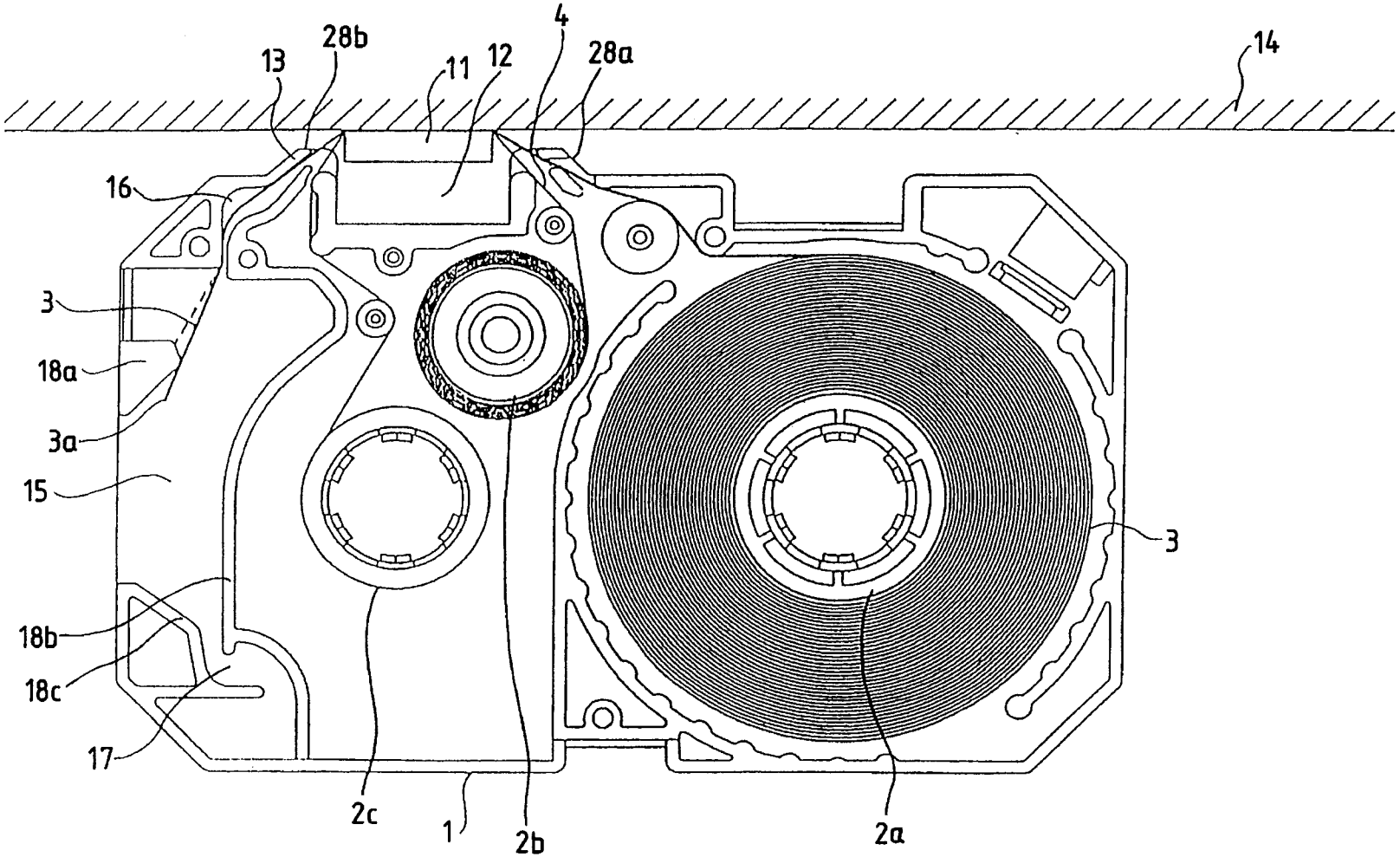
FIG. 4 is a diagram showing that an image transfer tape to which a print operation has been completed is guided into an accommodation unit when the print operation is executed by mounting the label creation cassette shown in FIG. 1 on the carriage of the thermal transfer printer.
Figure 5:
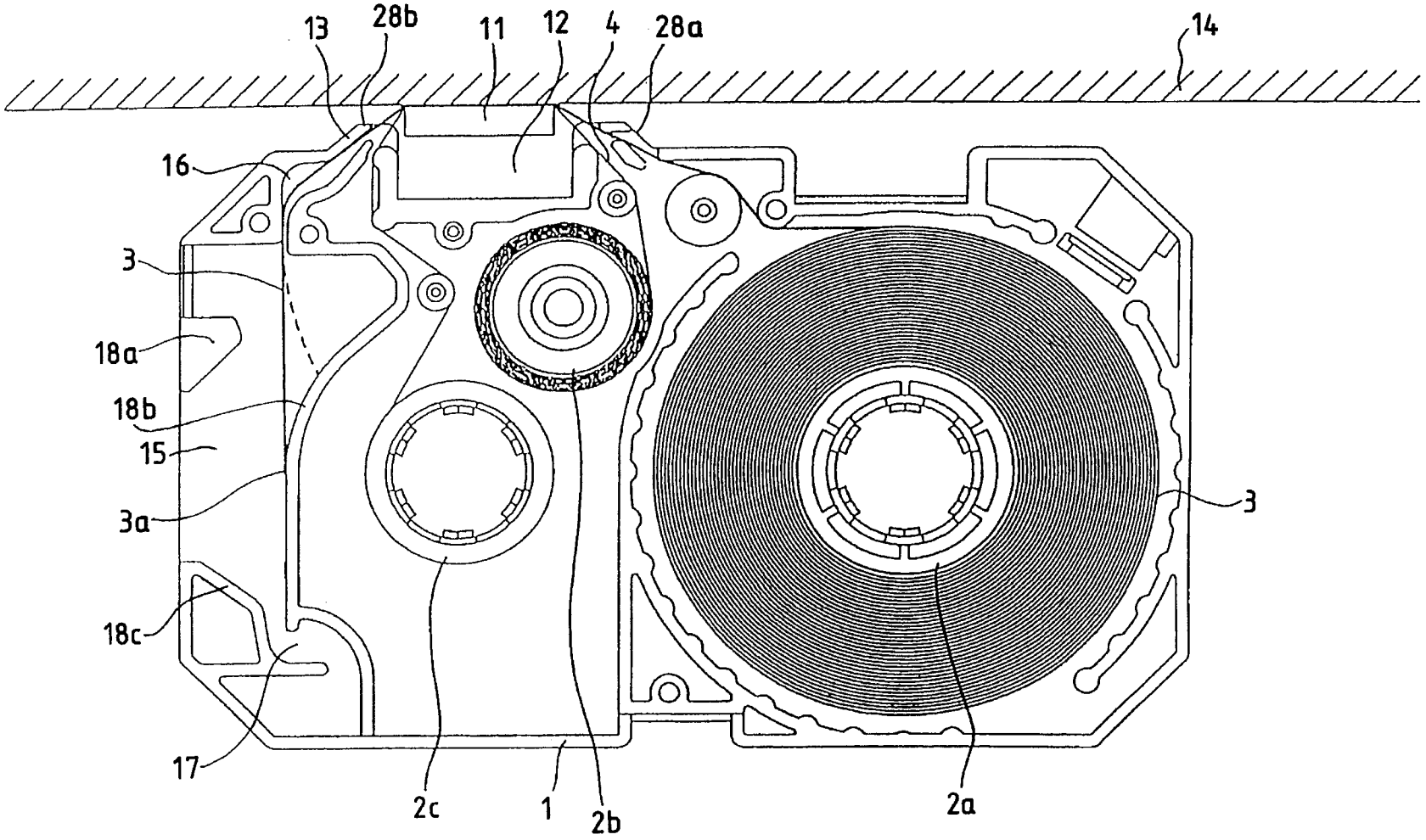
FIG. 5 is a diagram showing the state that the image transfer tape is further transferred into the accommodation unit from the state shown in FIG. 4 and guided to a holding unit.
Figure 6:
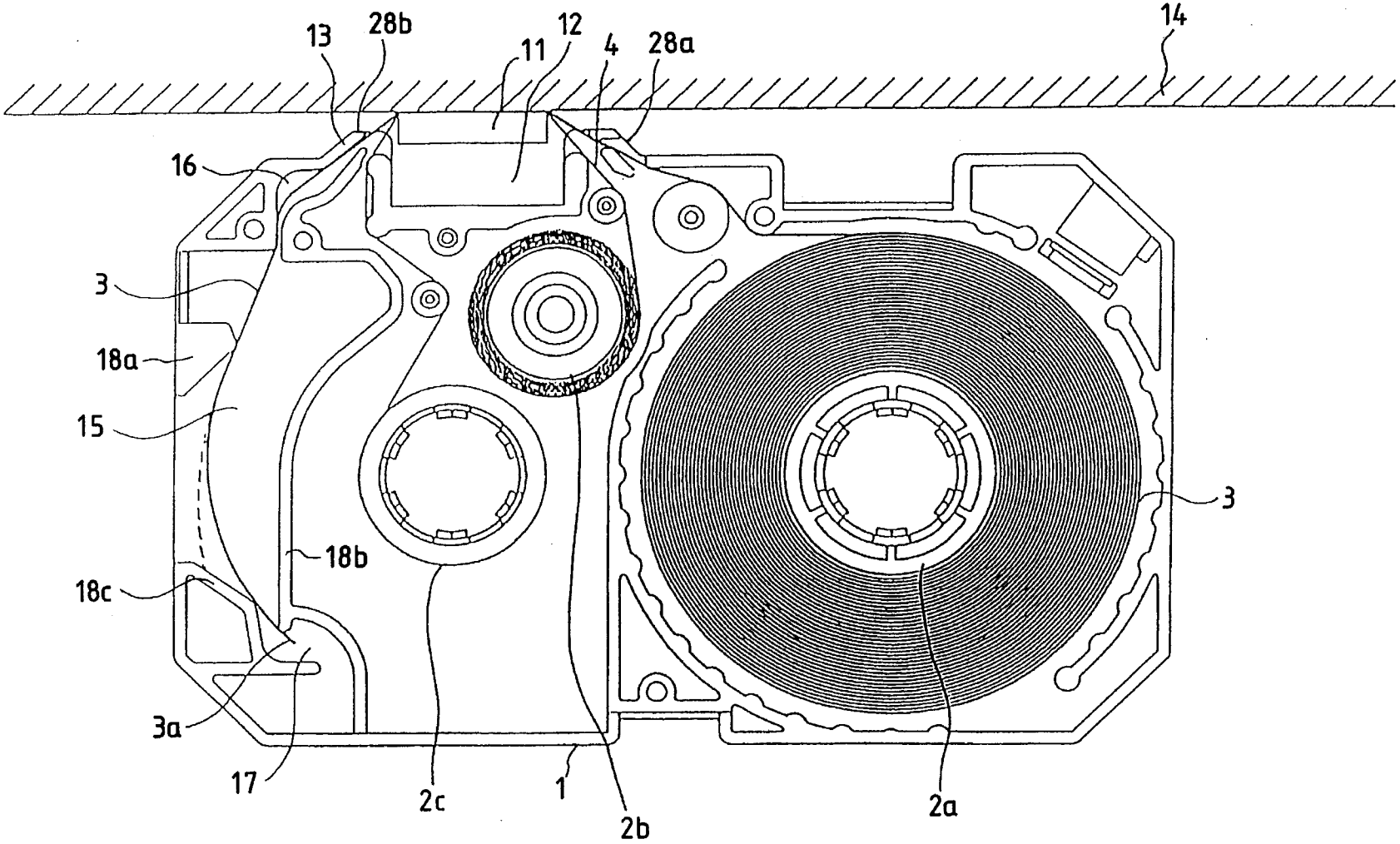
FIG. 6 is a diagram showing the state that the image transfer tape is further transferred into the accommodation unit from the state shown in FIG. 5 and the front end thereof has reached the holding unit.

As shown in FIG. 4 to FIG. 6, as the image transfer tape 3 is fed, the front end 3*a* thereof is introduced to the holding unit 17 by being guided by the guide members 18*a*, 18*b*, 18*c* constituting the accommodation unit 15.

Figure 7:
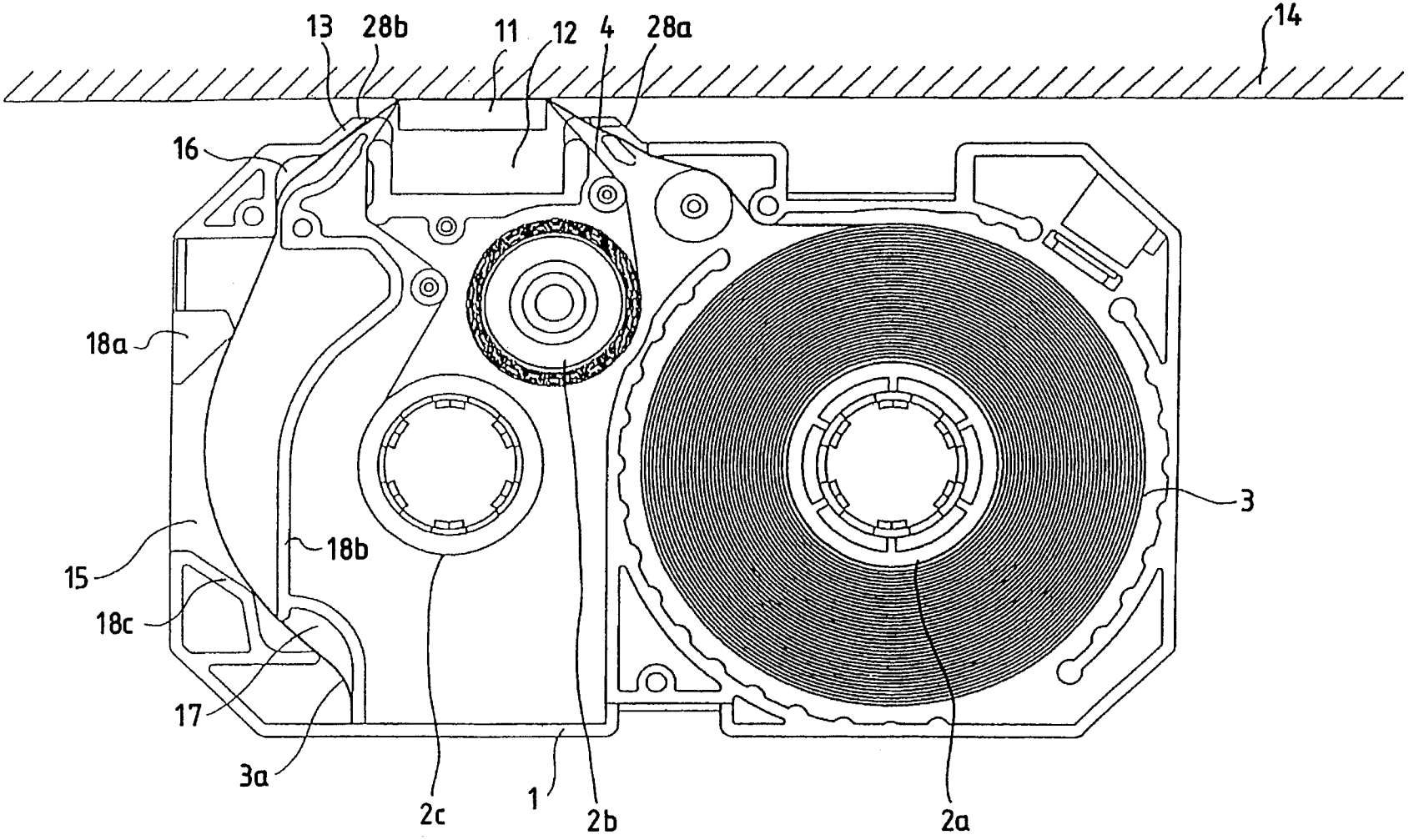
FIG. 7 is a diagram showing the state that the image transfer tape is further transferred into the accommodation unit from the state shown in FIG. 6 and the front end thereof has been completely held by the holding unit.

FIG. 7 shows the state that the front end 3*a* of the image transfer tape 3 has been completely held by the holding unit 17 and as shown in the figure, the front end 3*a* introduced up to the holding unit 17 is held by the stepwise-shaped holding unit 17 formed backwardly of the ribbon cassette case 1.

Figure 8:
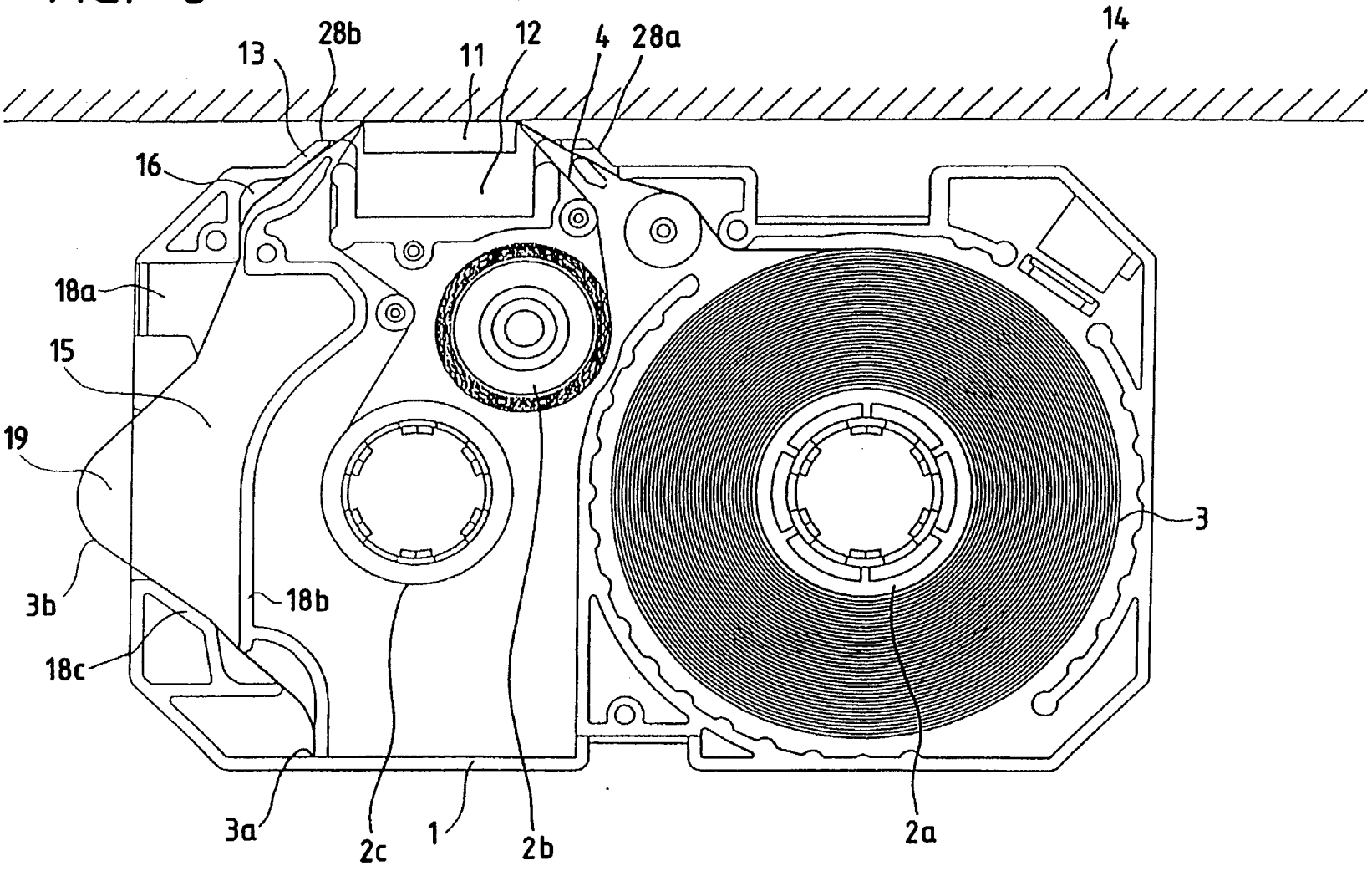
FIG. 8 is a diagram showing the state that the image transfer tape is further transferred into the accommodation unit from the state shown in FIG. 7 and begins to be taken out to the outside of the a cassette case while being curved, as a print operation proceeds.
Figure 9:
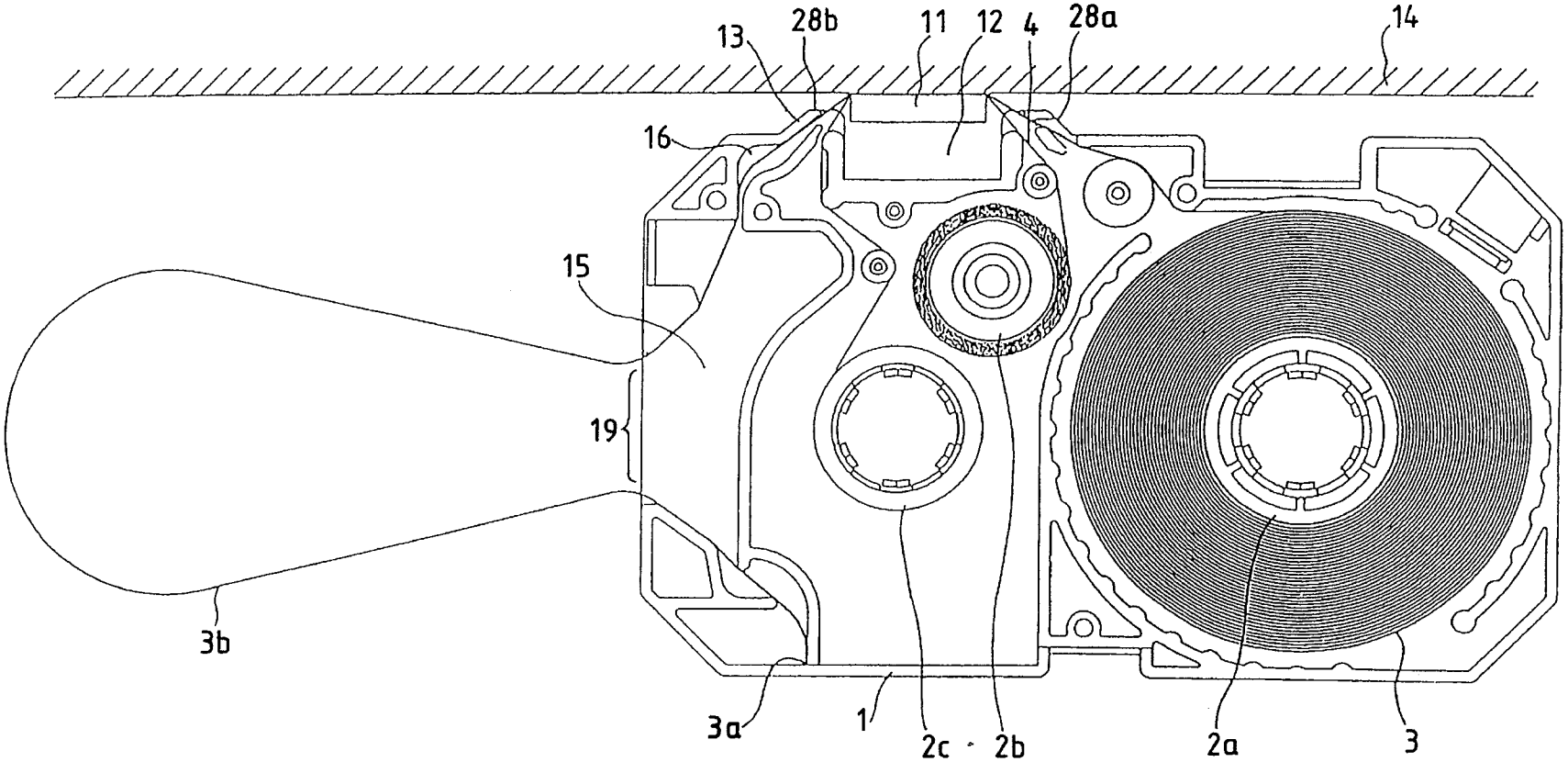
FIG. 9 is a diagram showing the state that the image transfer tape is further transferred into the accommodation unit from the state shown in FIG. 8 and terminates to be taken out to the outside of the a cassette case while being curved, as the print operation proceeds.

FIGS. 8 and 9 show the state that as the print operation proceeds and the image transfer tape 3 is further transferred, the image transfer tape 3 which cannot be accommodated in the accommodation unit 15 is taken out to the outside of the cassette case 1 from the opening 19 formed to the accommodation unit 15 while being curved. More specifically, as shown in the figures, the front end 3*a* is held by the holding unit 17 as well as with the proceed of the print operation (with the movement of the carriage from the left to the right in the figure), the trailing end 3*b* of the image transfer tape 3 which cannot be accommodated in the accommodation unit 15 is taken out to the outside of the cassette case 1 from the first opening 19 formed to substantially the center of the accommodation unit 15 on the side surface of the ribbon cassette case 1 while being curved.

As described above, since the image transfer tape 3 to which the print operation has been completed is continuously held in the ribbon cassette case 1 in the curved form even if its length is increased, the image transfer tape 3 is not dragged and moved in the printer by the reciprocate motion of the carriage 8, and thus the surface of the image transfer tape 3 to which the print operation has been executed is always kept in a clean state.

Figure 10:
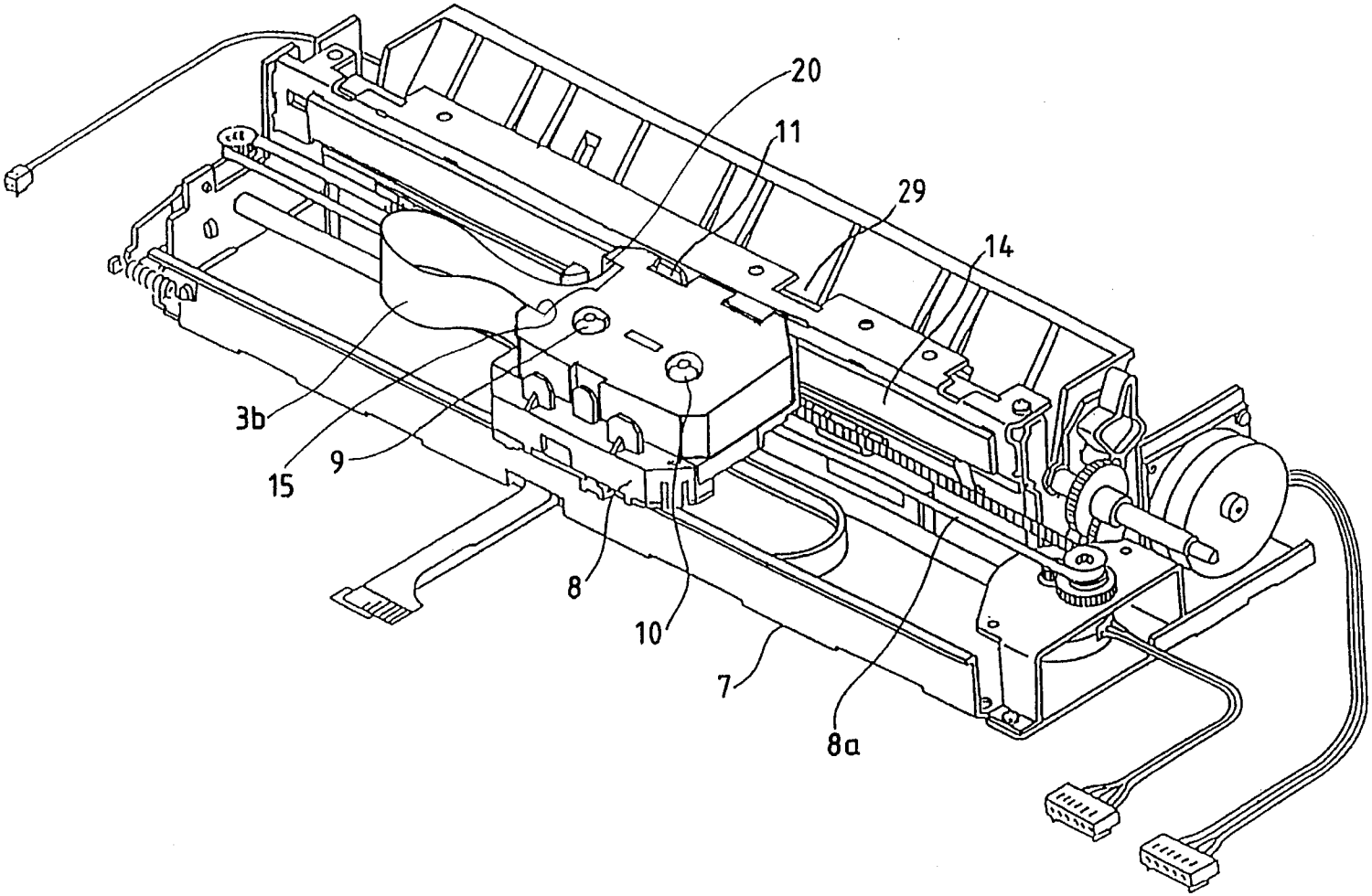
FIG. 10 is a diagram showing the state that the label creation cassette shown in FIG. 1 is mounted on a printer.

FIG. 10 is a perspective view showing the state that the label creation cassette of this embodiment is mounted on the carriage 8 of the thermal transfer printer 7. As shown in FIG. 10, a second opening 20 is formed to the portion on the upper surface of the case 1 of the label creation cassette which confronts with the accommodation unit 15 so that a portion of the image transfer tape 3 accommodated in the accommodation unit 15 is exposed. A user can cut off the image transfer tape 3 to which the print operation has been completed by inserting scissors through the second opening 20.

Figure 11A:
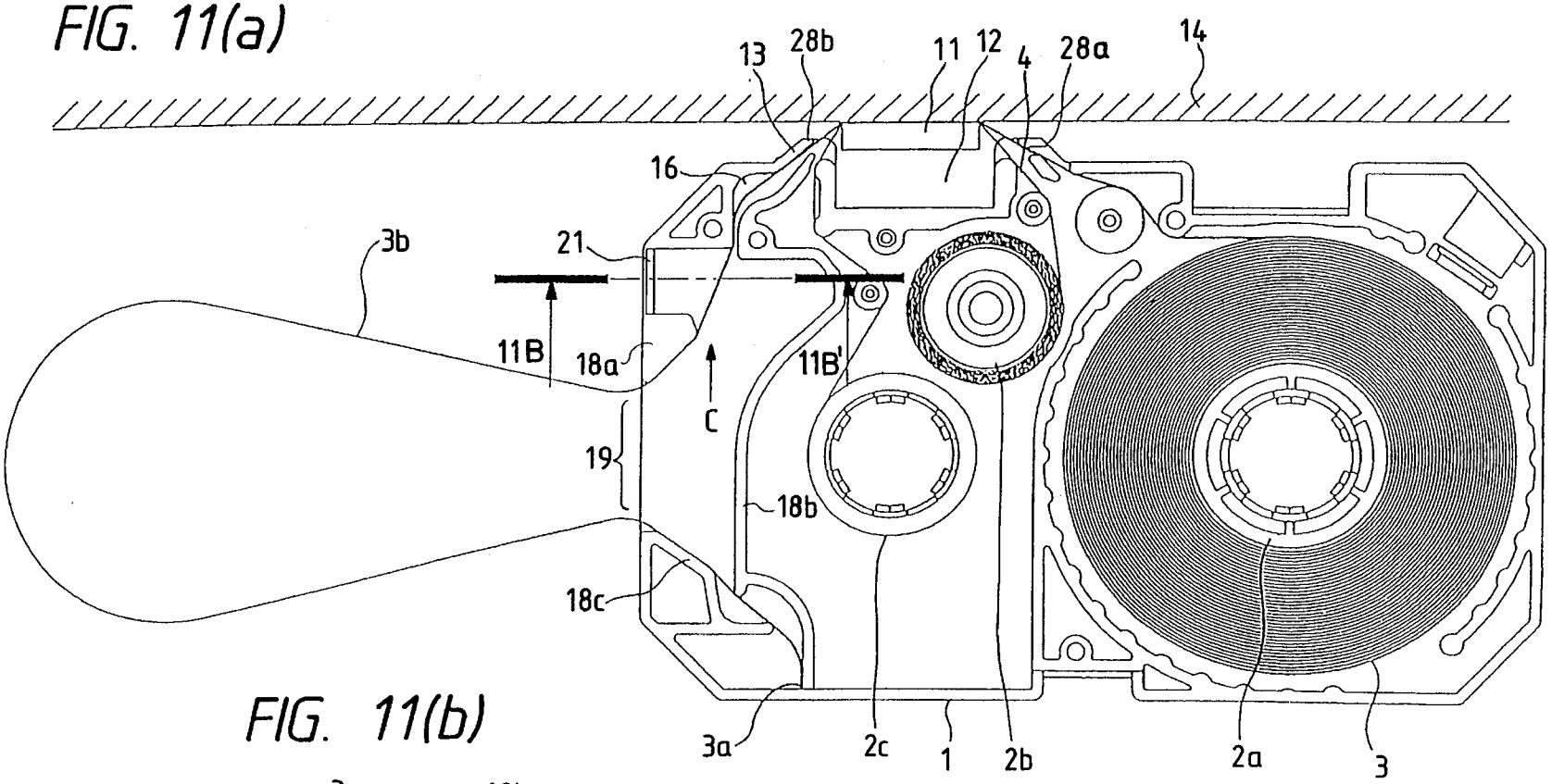
FIGS. 11 (*a*) and 11 (*b*) are diagrams explaining the arrangement of an opening into which scissors formed to the label creation cassette shown in FIG. 1 is inserted, wherein, FIG. 11 (*a*) is a plan view of the opening and FIG. 11 (*b*) is a cross sectional view of the main portion thereof.
Figure 11B:
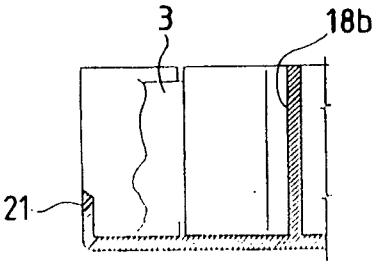
Figure 12:
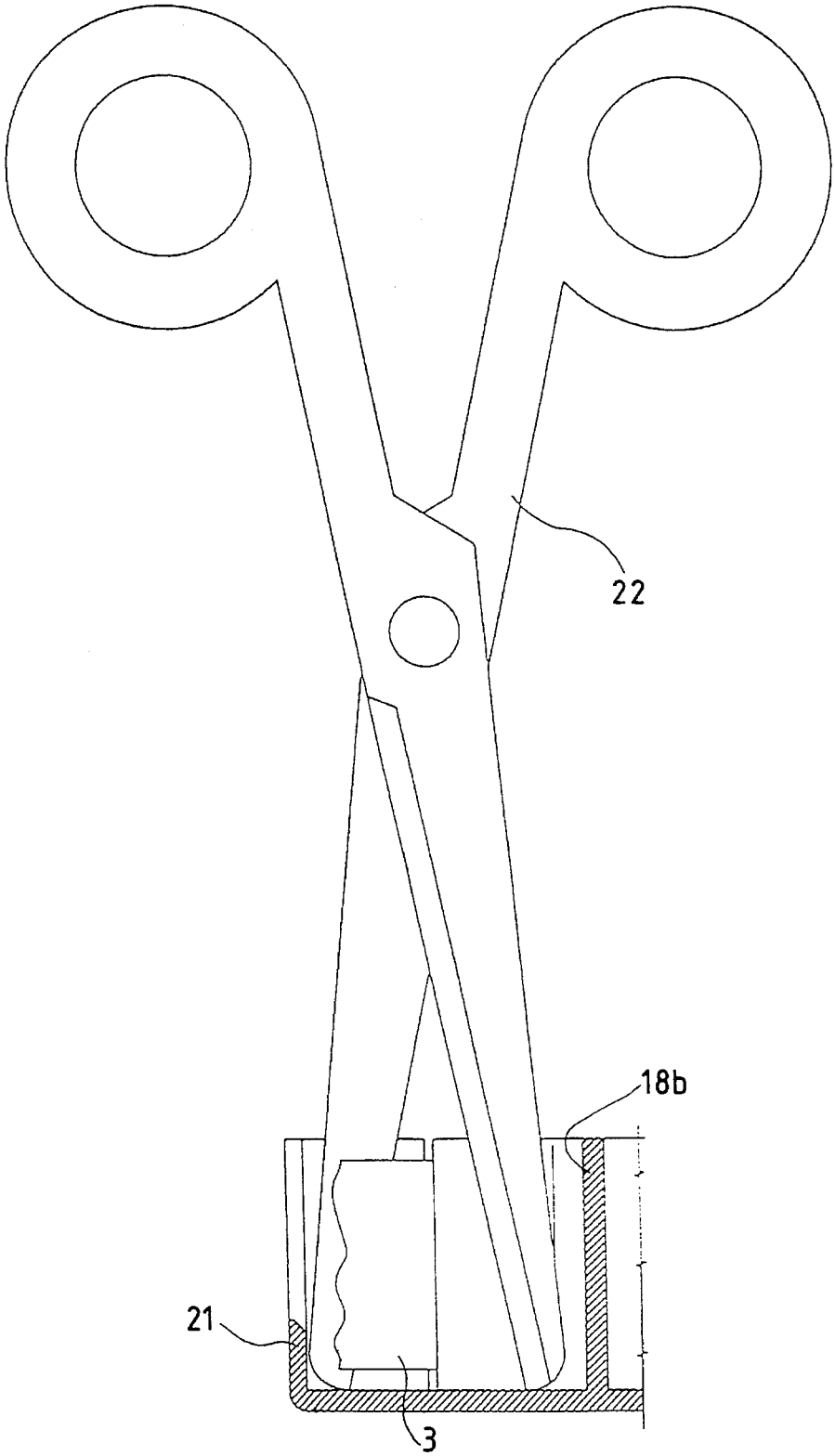
FIG. 12 is a diagram showing the state that an image transfer tape is cut off by the scissors through the opening shown in FIG. 11.

FIGS. 11 (*a*) and (*b*) and FIG. 12 are diagrams explaining the state of the second opening 20, wherein FIG. 11 (*b*) and FIG. 12 are cross sectional views showing the cross section thereof taken along the line A—A' in FIG. 11 (*a*) and viewed from the direction of an arrow C. As shown in the figures, a portion of the wall of the accommodation unit 15 in the vicinity of the opening 20 is formed as a wall 21 lowered stepwise from other portion. With this arrangement, when the scissors 22 are inserted from the second opening 20, they can be completely opened and the extreme end of the scissors once inserted does not project to the outside of the ribbon cassette case 1 by being regulated by the one-step lower wall 21, as shown in FIG. 12, and thus when the image transfer tape 3 is cut off, other parts such as a belt 8*a* for driving the carriage 8 of the thermal transfer printer 7 and the like are not damaged by the scissors 22.

Figure 13:
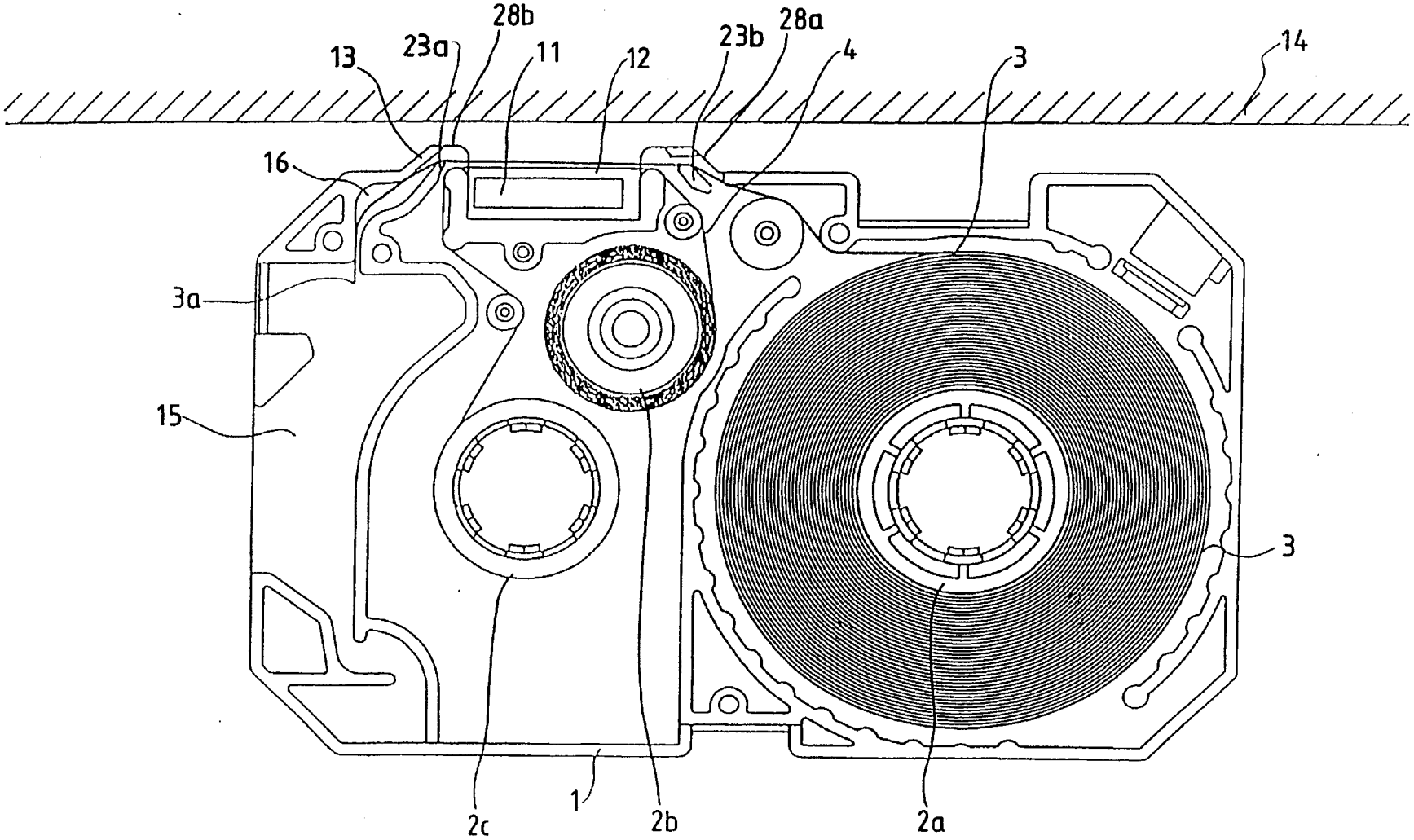
FIG. 13 is a diagram showing the state that the label creation cassette shown in FIG. 1 is mounted on the carriage of a thermal transfer printer and a print operation is not executed.

FIG. 13 is a diagram showing the non-printing state in which the label creation cassette of this embodiment is mounted on the carriage of the thermal transfer printer, i.e. the state that the thermal head 11 is not pressed against the platen 14. As shown in FIG. 13, when no print operation is executed, the ink ribbon 4 is separated from the image transfer tape 3 by a pair of separating portions 23*a*, 23*b* disposed in the vicinity of the openings 26 and 27 of the recessed portion 12 to which the thermal head 11 is disposed in the ribbon cassette case 1, and thus even if they are not used for a long time, there is no possibility that the ink ribbon 4 is adhered to the image transfer tape 3 and a trouble is caused when they are used next time.

Further, when the separation portions 23*a*, 23*b* is disposed to any one side of the recessed portion, although the ink ribbon 4 and image transfer tape 3 are not in a complete non-contact state but an area in which they are in contact to each other can be greatly reduced, and thus substantially the same effect as that in which the separating portions are disposed on both sides in the vicinity of the recessed portion 12 can be obtained.

Figure 14:
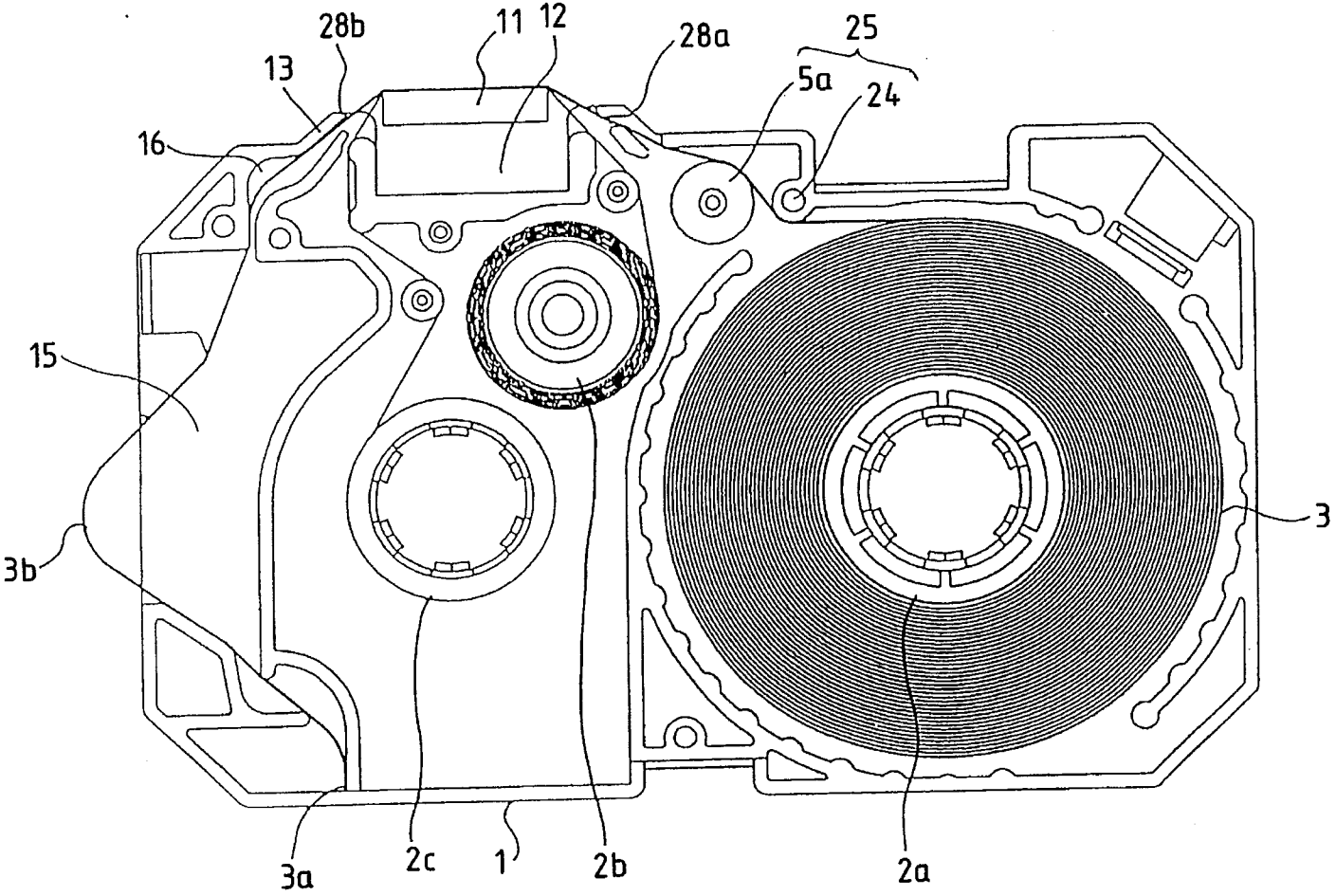
FIG. 14 is a diagram showing the arrangement of a curl correction unit in the label creation cassette shown in FIG. 1 when an image transfer tape begins to be used.
Figure 15:
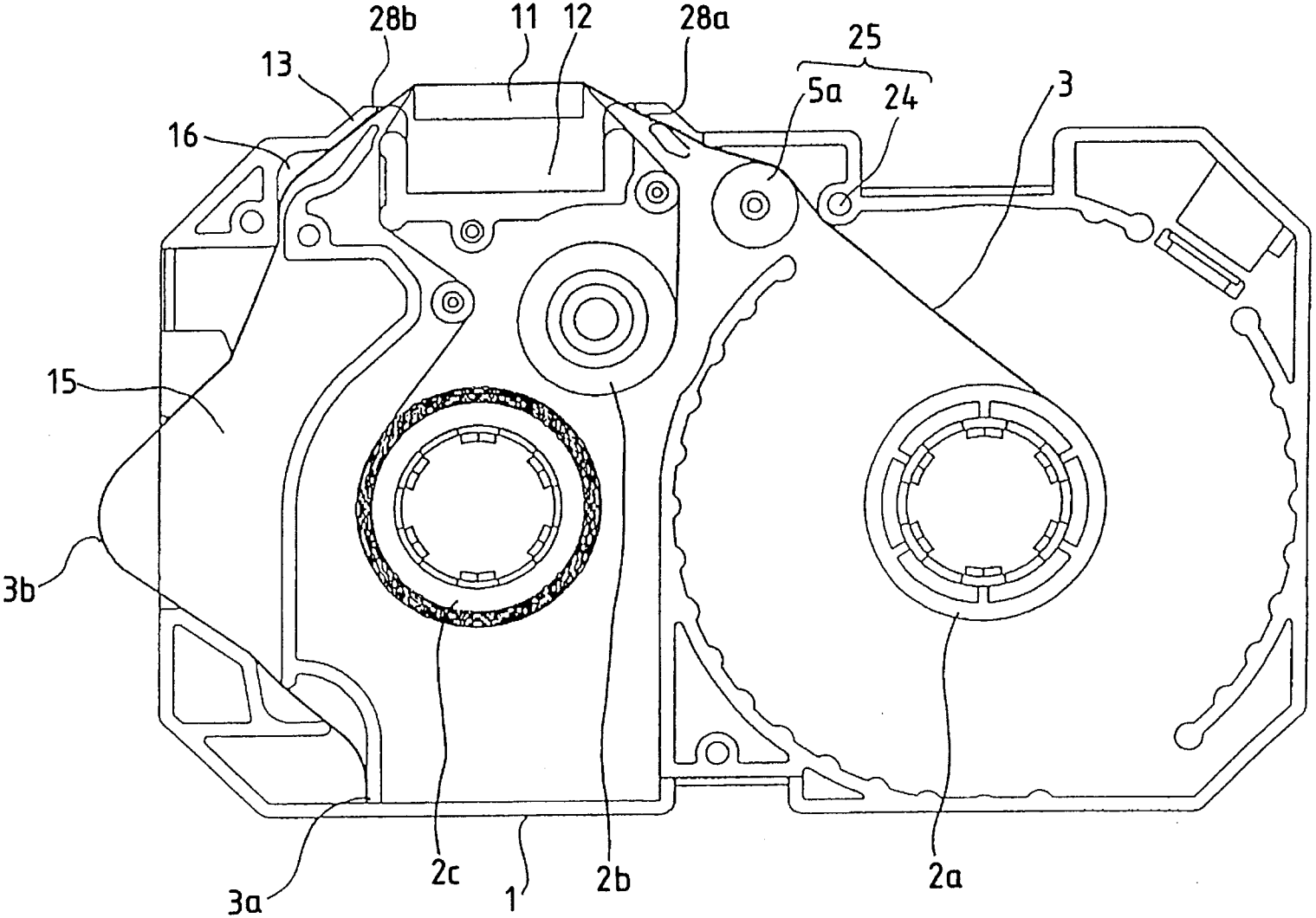
FIG. 15 is a diagram showing the arrangement of a curl correction unit in the label creation cassette shown in FIG. 1 when the image transfer tape has been used.

FIGS. 14 and 15 show the state in which the label creation cassette of this embodiment begins to be used and terminates to be used, respectively. A pressed member 24 pressed against the non-print-surface of the image transfer tape 3 at all times and the guide roller 5*a* pressed against the print-surface thereof act as a curl correction unit 25 for correcting the curling of the image transfer tape 3, the pressed member 24 being disposed on the upstream side of the image transfer tape 3 in the direction to which the image transfer tape is fed and the guide roller 5*a* being positioned at a location just downward of the pressed member 24, and thus the tendency to be wound of the image transfer tape 3 applied thereto by being wound around the core 2*a* on the feed-out side can be corrected just before a print operation is executed. Therefore, the ink ribbon 4 and image transfer tape 3 stably travel in the print operation and a good print quality can be obtained.

Figure 16:
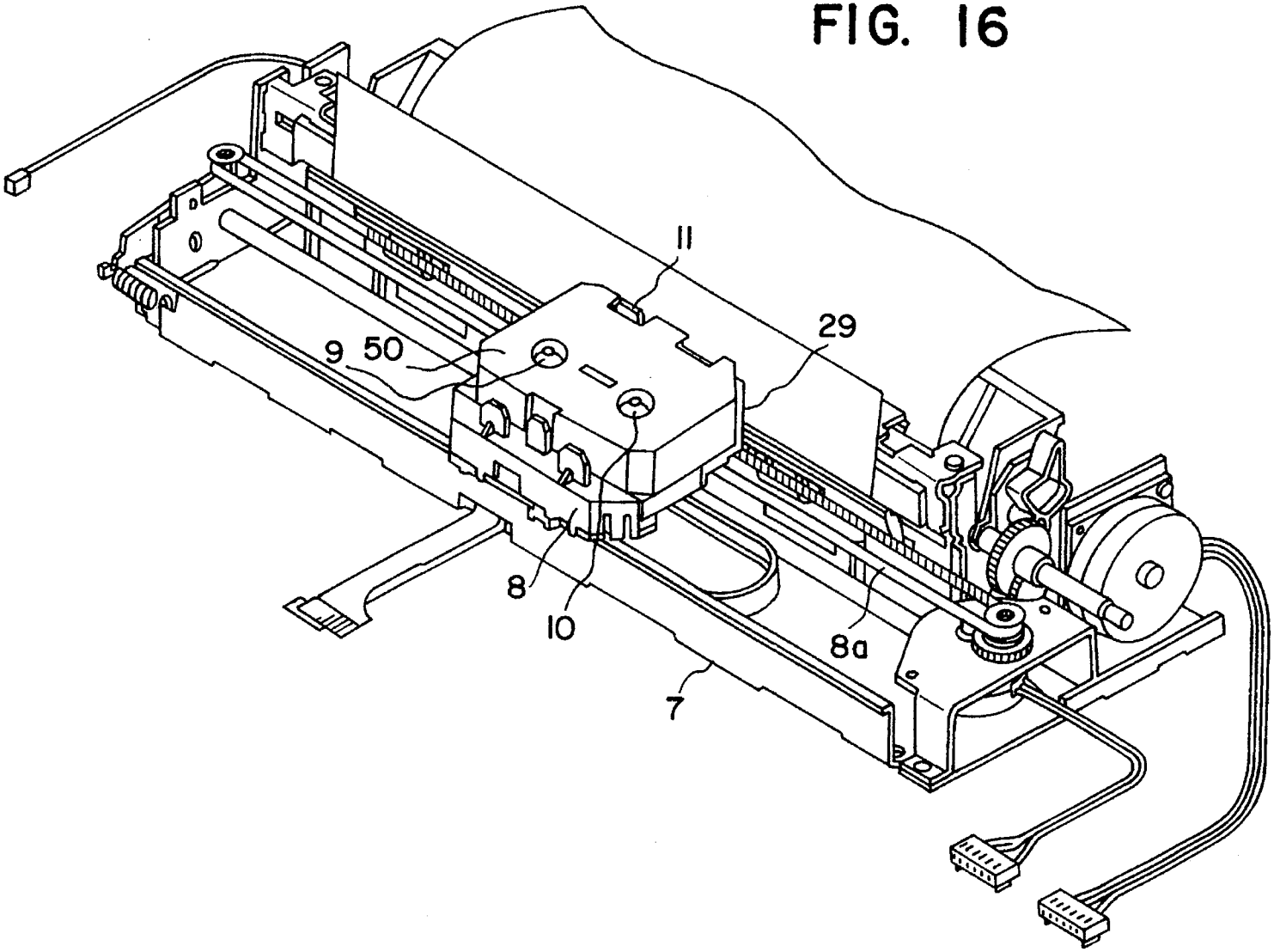
FIG. 16 is a diagram showing the state that an ink ribbon cassette used to execute a print operation to a usual paper is mounted on the thermal transfer printer of a wordprocessor which can use the label creation cassette of the present invention.

FIG. 16 is a diagram showing for reference the state that an ink ribbon cassette 50 accommodating only the ink ribbon which can be used to execute a print operation only to a usual paper is mounted on the carriage 8 of the thermal transfer printer 7 for a wordprocessor capable of using the label creation cassette of the preset invention. The label creation cassette of this embodiment shown in FIG. 10 has an outside configuration very similar to that of the ink ribbon cassette usually used.

Further, although the aforesaid guide portion 13, accommodation unit 15, holding unit 17 and the like are integrally formed with the cassette case itself in this embodiment, they may be detachably formed independently of the cassette case.

FIG. 17 to FIG. 21 show a second embodiment of the present invention. Note, the same numerals as used in the aforesaid first embodiment are used to denote the same parts and the description thereof is omitted.

The label creation cassette of this embodiment is arranged in the same way as that of the first embodiment that an image transfer tape 3 and an ink ribbon 4 are accommodated in a cassette case 1 and the side of the cassette case 1 confronting with the platen 14 of a printer in the vicinity of the recessed portion 12 of the cassette case 1 is formed as projections 28*a*, 28*b* projecting toward the platen 14 and the label creation cassette is mounted on the carriage 8 of a thermal transfer printer to execute a print operation to the image transfer tape 3. The label creation cassette of this embodiment, however, is different from that of the first embodiment in that a feed path of the image transfer tape 3 from a supply core 2*a* to a print unit is substantially linearly formed in the initial state of use of an ink ribbon cassette and that the feed path of the image transfer tape 3 to which the print operation has been completed is arranged differently from that of the first embodiment.

More specifically, in this embodiment, the image transfer tape 3 is accommodated in the cassette case 1 in such a manner that at the initial state of use of the cassette, the image transfer tape 3 is abutted against the wall 31 formed to the cassette case 1 between the position 30 from which the image transfer tape 3 is fed out from the supply core 2*a* and the opening 26 formed to the recessed portion 12 for taking out the image transfer tape 3 to the outside of the cassette case I so that the feed path of the image transfer tape 3 is substantially linearly arranged therebetween. This linear state of the feed path is maintained until the image transfer tape 3 has been used as shown by the dotted line in FIG. 17.

In this embodiment, since the feed path of the image transfer tape 3 is formed to the configuration as described above between the aforesaid position 30 and the opening 26, the image transfer tape 3 can be stably drawn out at all times in a print operation by reducing a drawing-out load of the image transfer tape 3.

Note, in this embodiment, although the feed path is maintained in the linear state from the initial use of the ink ribbon cassette to the final use thereof, the image transfer tape 3 can be stably drawn out by reducing the drawing-out load thereof so long as the feed path is arranged to the linear state at least at the initial use thereof at which the drawing-out load of the image transfer tape 3 is maximized, and thus the purpose of this arrangement can be achieved.

Further, in this embodiment, the image transfer tape 3 to which the print operation has been completed and introduced again into the cassette case 1 through the opening 27 formed to the recessed portion 12 is guided by a guide member 13 toward a direction apart from the platen 14 and then reaches the opening 34 formed to the side of the cassette case 1 by being guided by guide walls 32 and 33 and is taken out to the outside of the cassette case 1 from the opening 34.

Figure 17:
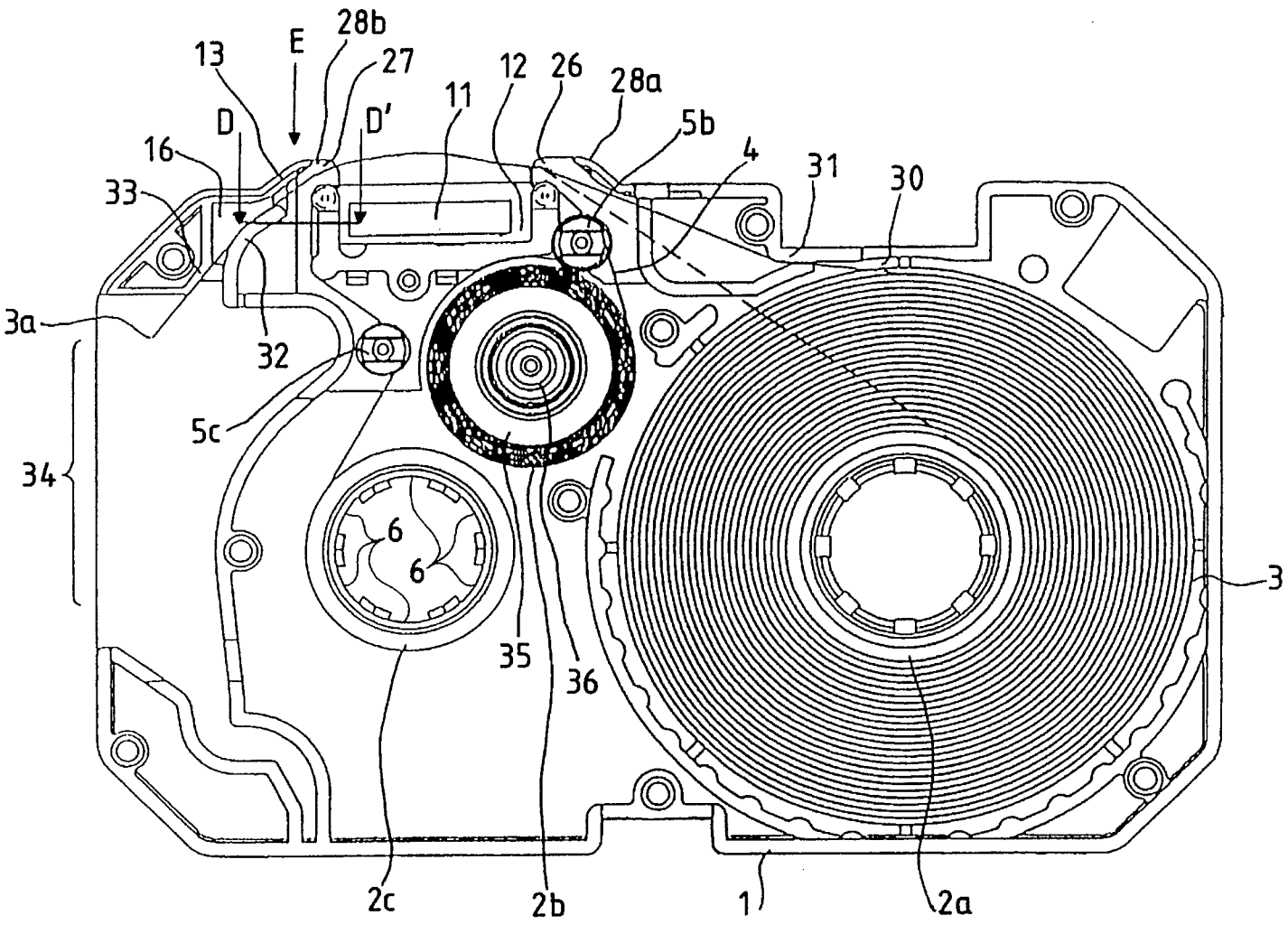
FIG. 17 is a plan view of a second embodiment of the label creation cassette of the present invention.
Figure 18A:
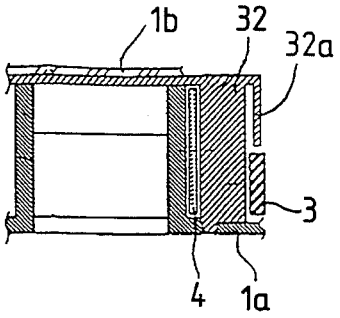
FIG. 18 is a cross sectional view of the main portion of FIG. 17 taken along the line B—B' of FIG. 17 and viewed from the direction of an arrow C to explain the arrangement of a portion where an image transfer tape to which a print operation has been completed and an ink ribbon are introduced again into the case of the label creation cassette shown in FIG. 17.
Figure 18B:
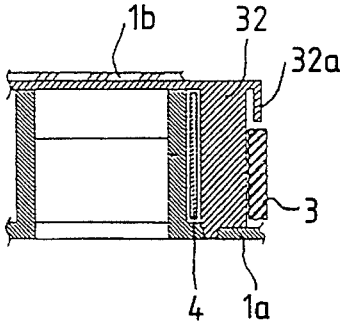
Figure 18C:
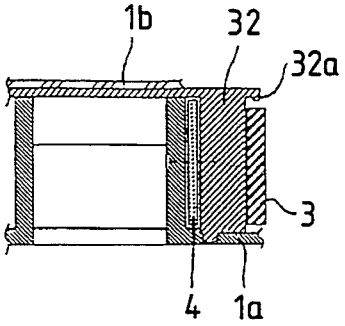

FIG. 18 is a cross sectional view taken along the line D—D' in FIG. 17 and viewed from the direction of the arrow E in the figure to explain the arrangement of the opening 27 into which the image transfer tape 3 to which the print operation has been completed and the ink ribbon 4 are introduced again into the cassette case 1 and the arrangement of the vicinity of the guide wall 31.

Note, FIGS. 18 (*a*), (*b*) and (*c*) show that the arrangement of the guide wall 32 is different depending upon a width of the image transfer tape 3 because the image transfer tape 3 accommodated in the cassette case 1 for use has a plurality of kinds of width.

As shown in the figures, the image transfer tape 3 to which the print operation has been completed and the ink ribbon 4 are fed in a different direction, respectively and the guide wall 32 for separating them has a guide wall 32*a* formed thereto in accordance with a width of the image transfer tape 3 accommodated in the cassette case 1, and thus the image transfer tape 3 is guided with out moving obliquely toward the direction of the opening 34 with the width direction thereof being guided by the guide arm 32*a*.

Figure 19:
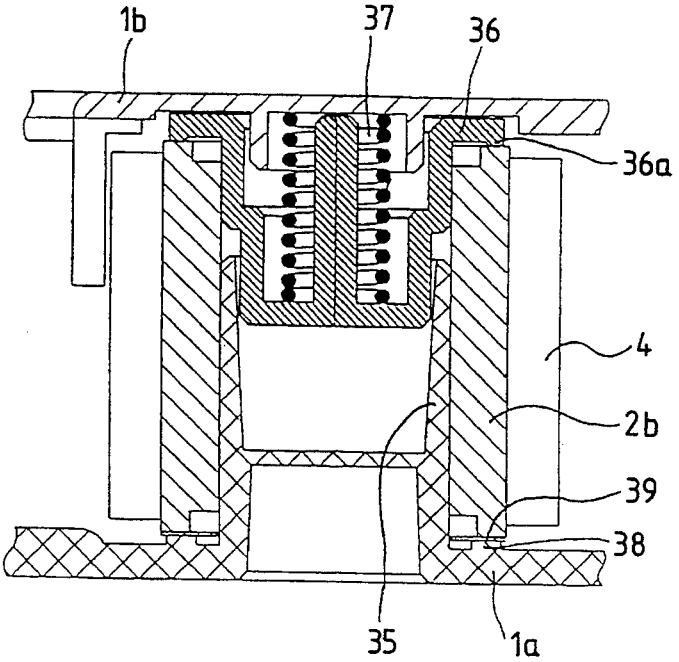
FIG. 19 is a cross sectional view of the main portion of a load application means provided with an ink supply core in the label creation cassette shown in FIG. 17 to explain the arrangement of the load application means.

Further, in this embodiment, an ink ribbon supply core 2*b* around which the ink ribbon 4 is wound is provided with a load application means for applying a predetermined load to the rotation of the supply core 2*b*. FIG. 19 is a diagram showing the arrangement of the ink ribbon supply core 2*b* in the label creation cassette of this embodiment to explain the load application means.

The cylindrical supply core 2*b* is inserted into the cylindrical projection 35 standing on the upper surface of the lower side case 1*a* constituting the cassette case 1 so that the inner periphery of the core 2*b* is in contact with the outer periphery of the projection 35, and a spacer 36 is disposed between the upper surface of the supply core 2*b* and an upper side cassette 1*b*, the spacer 36 holding the supply core 2*b* in such a manner that a portion thereof is engaged with the projection 35. An annular collar 36*a* formed to the spacer 36 comes into contact with the upper surface of the supply core 2*b*.

Further, a coil spring 37 is further interposed between the spacer 36 and the upper side cassette case 1*b*, and thus the supply core 2*b* is always urged toward the lower side case 1*b* through the spacer 36 by the urging force of the coil spring 37. Further, an annular pedestal 38 is disposed to the periphery of the projection 35 on the upper surface of the lower side case 1*a* and the lower surface of the supply core 2*b* is pressed against the pedestal 38 through a washer composed of a material with a low friction coefficient such as fluororesin or the like by the urging force of the aforesaid coil spring 37.

With this arrangement, predetermined frictional forces are produced to the supply core 2*b* at the contact portions of the lower side cassette case 1*a* with the washer 39, the washer 39 with the lower surface of the supply core 2*b* and the spacer 36 with the upper surface of the supply core 2*b*, respectively and thus the supply core 2*b* is always applied with a predetermined load by the frictional forces when it is rotated.

Next, the state in which a print operation is executed to the image transfer tape 3 by using the label creation cassette of this embodiment will be described with reference to FIG. 20.

Figure 20A:
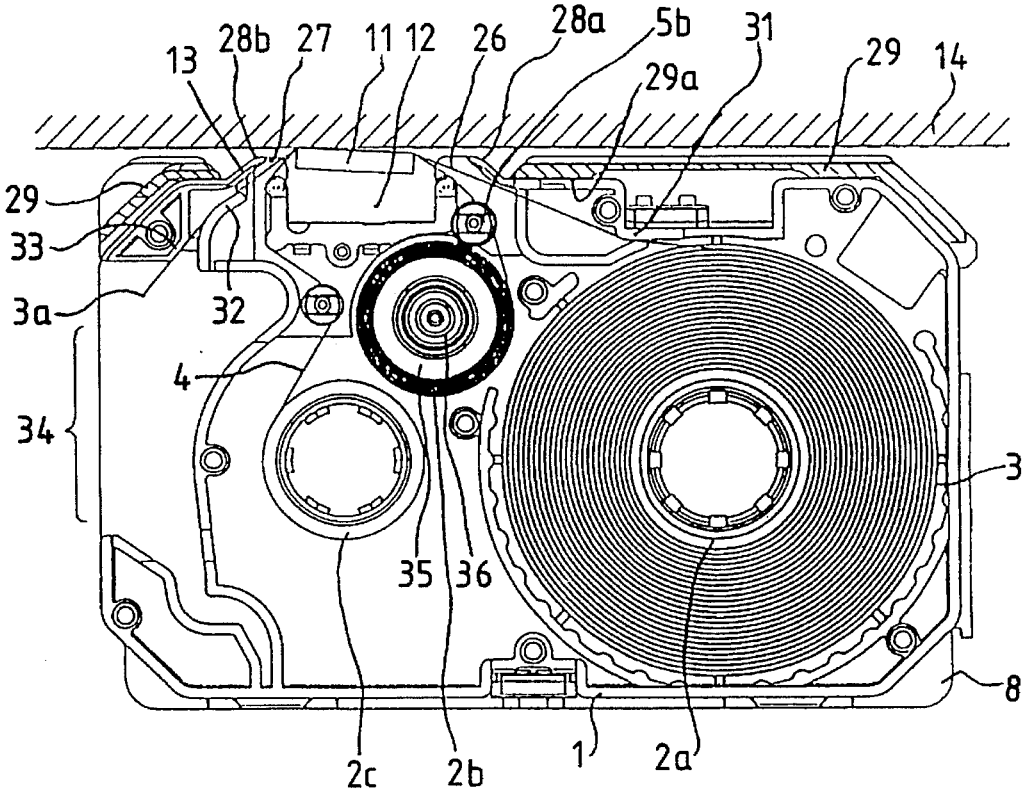
FIG. 20 is a diagram showing the state that a print operation is executed by mounting the label creation cassette shown in FIG. 17 on the carriage of a thermal transfer printer, wherein FIG. 20 (*a*) is a plan view of the main portion of the label creation cassette and FIG. 20 (*b*) is a cross sectional view of the main portion thereof.
Figure 20B:
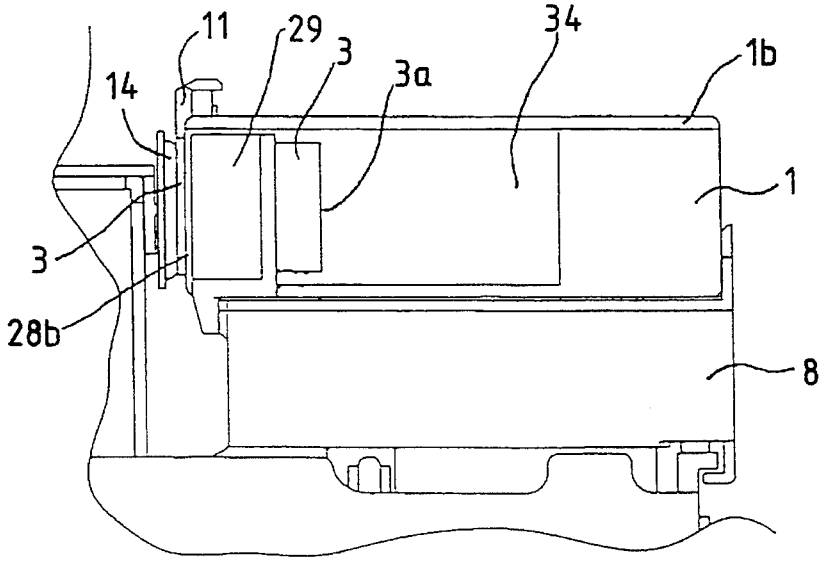

FIG. 20 is a diagram showing the state that a print operation is executed with the label creation cassette of this embodiment mounted on the carriage 8 of a thermal transfer printer 7, wherein FIG. 20 (*a*) is a plan view thereof and FIG. 20 (*b*) is a side view thereof.

As shown in the figures, the projections 28*a* and 28*b* of the cassette case 1 are located nearer to the platen 14 side than the inner side surface 29*a* of the paper guide 29 provided with the carriage 8 also in this embodiment so that the label creation cassette can be smoothly mounted on the carriage 8 as well as the image transfer tape 3 can be securely pressed against the platen 14 by a thermal head 11 when the print operation is executed to thereby enable the image transfer tape 3 to be securely drawn out from the cassette case 1.

Further, since the supply core 2*b* around which the ink ribbon 4 is wound is always supplied with the predetermined load with respect to the rotation thereof by the aforesaid load application means, no loosening is caused to the ink ribbon 4 when the print operation is executed or the cassette is transported, and thus the ink ribbon 4 can be stably fed to the print unit.

Figure 21:
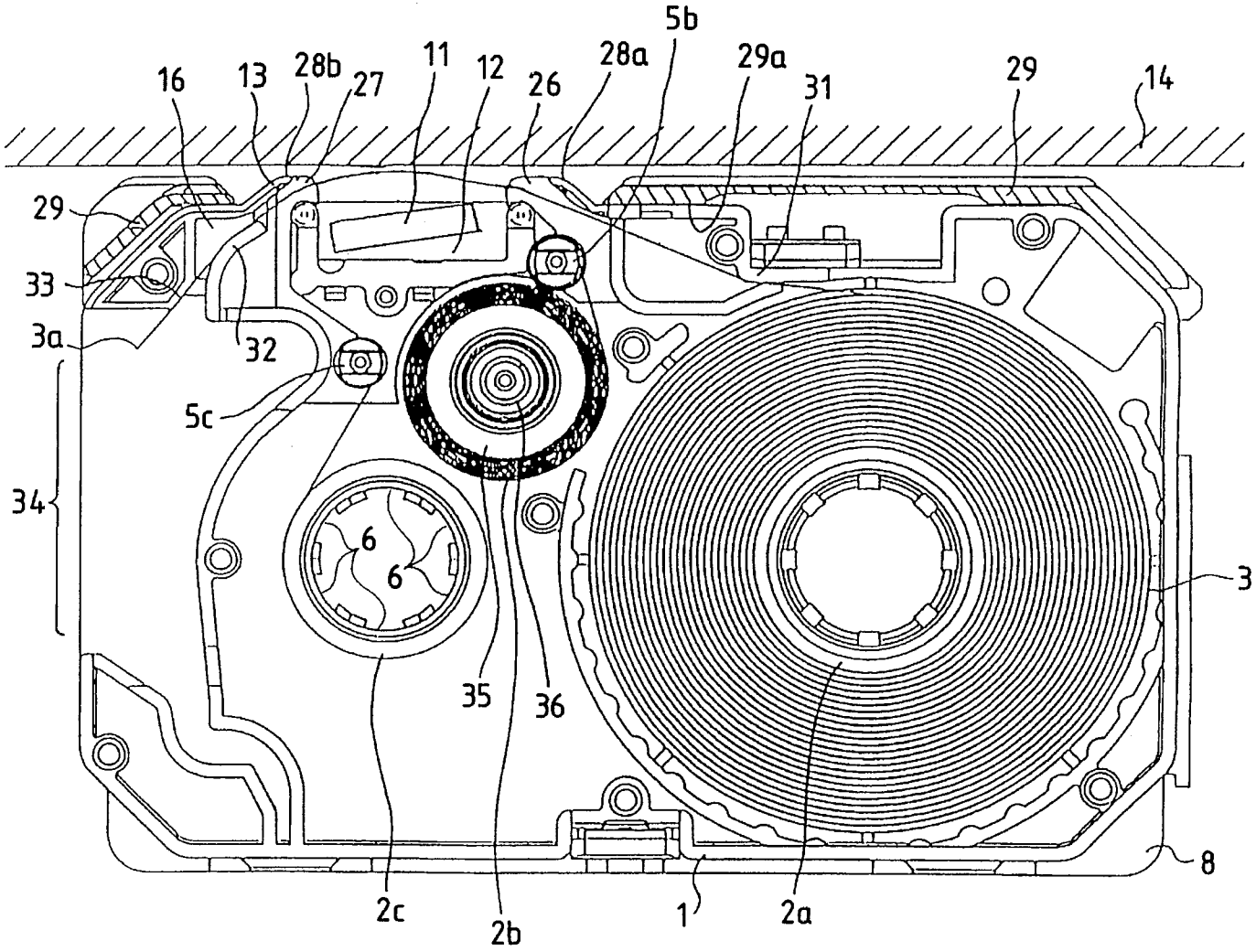
FIG. 21 is a diagram showing the label creation cassette shown in FIG. 17 mounted on the carriage of a thermal transfer printer and a print operation is not executed.

Further, FIG. 21 is a diagram showing the state before a print operation is started with the label creation cassette of this embodiment mounted on the carriage 8 of the thermal transfer printer. As shown in FIG. 21, the thermal head 11 is in a so-called head-up state in which it is not pressed against the platen. At this time, the image transfer tape 3 between the thermal head 11 and the platen 14 in the recessed portion 12 is located nearer to the platen 14 side than the inner surface 29*a* of the paper guide 29 provided with the carriage 8 by the projections 28*a* and 28*b* disposed to the cassette case 1. Therefore, when the label creation cassette is mounted on the carriage of the thermal transfer printer, the image transfer tape 3 does not come into contact with the thermal head 11, and thus when the cassette is mounted on the carriage 8, there is no possibility that wrinkles are produced to the ink ribbon 11 located inside the image transfer tape 3 by that the ink ribbon 4 is caught by the thermal head 11. As a result, the label creation cassette can be smoothly and securely mounted on the carriage 8.

Figure 22:
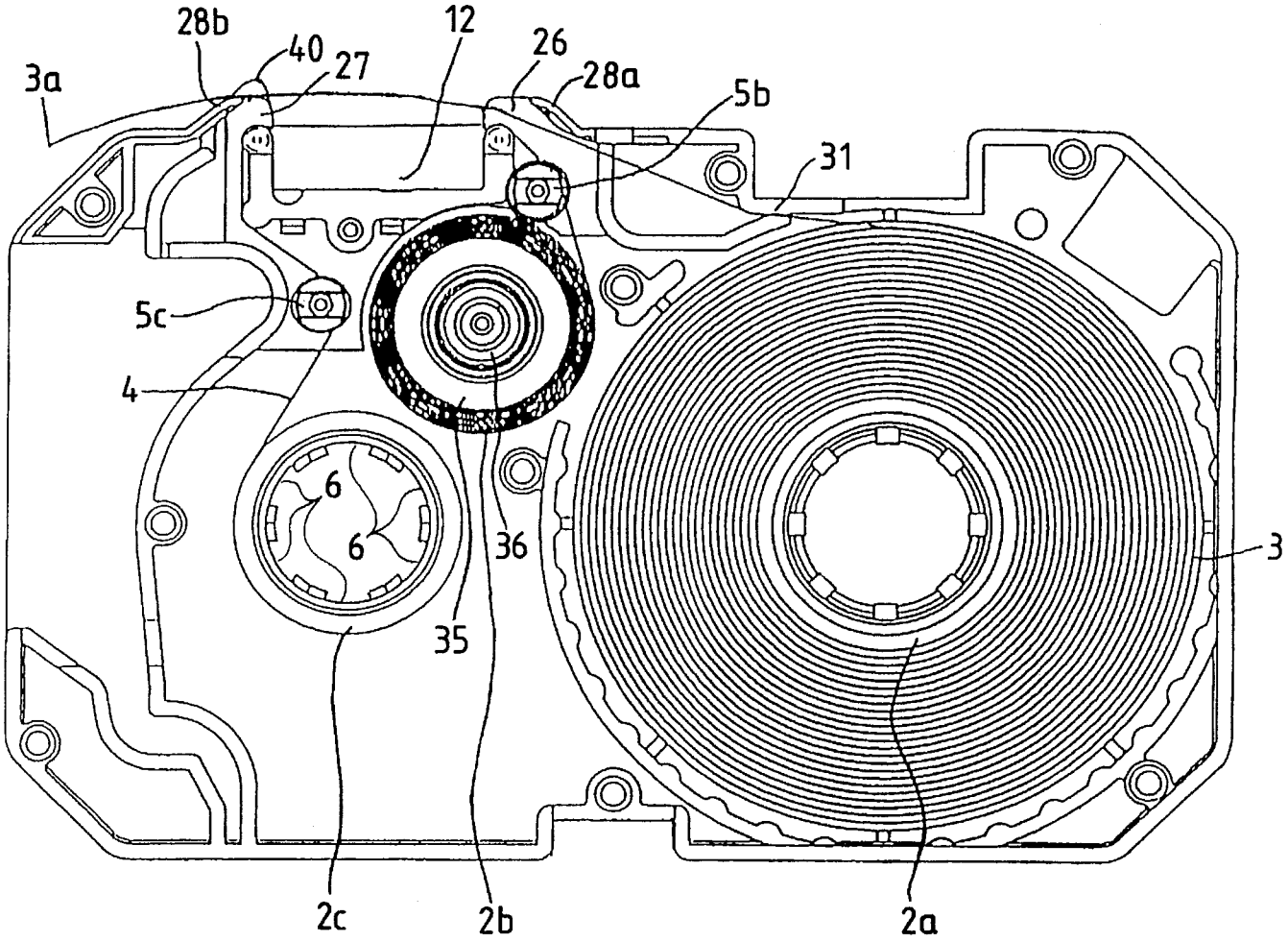
FIG. 22 is a plan view showing the main portion of a third embodiment of the label creation cassette of the present invention.

FIGS. 22 and 23 shows a third embodiment of the present invention. Note, the same numerals as used in the aforesaid first or second embodiment are used to denote the same parts and the description thereof is omitted.

The label creation cassette of this embodiment is arranged in the same way as that of the second embodiment such that an image transfer tape 3 and an ink ribbon 4 are accommodated in a cassette case 1 and the side of the cassette case 1 confronting with the platen 14 of a printer in the vicinity of the recessed portion 12 of the cassette case 1 is formed as projections 28*a*, 28*b* projecting toward the platen 14, and the label creation cassette is mounted on the carriage of a thermal transfer printer to execute a print operation to the image transfer tape 3 and the feed path from the supply core of the image transfer tape 3 to a print unit is substantially linearly formed in the initial state of use of a cassette. The label creation cassette of this embodiment, however, is different from that of the aforesaid second embodiment in that the cassette case 1 is not provided an accommodation unit for accommodating the image transfer tape 3 to which a print operation has been completed and that a guide member 40 is provided at the extreme end of the projection 28*b* to guide the width direction of the image transfer tape 3 to which a print operation has been completed so that the image transfer tape 3 to which the print operation has been completed is transferred substantially in parallel with the platen 14 by being guided by the guide member 40 without being introduced again into the cassette case 1.

Next, the state in which a print operation is executed to the image transfer tape 3 by using the label creation cassette of this embodiment will be described with reference to FIGS. 23*a*, 23*b*.

Figure 23A:
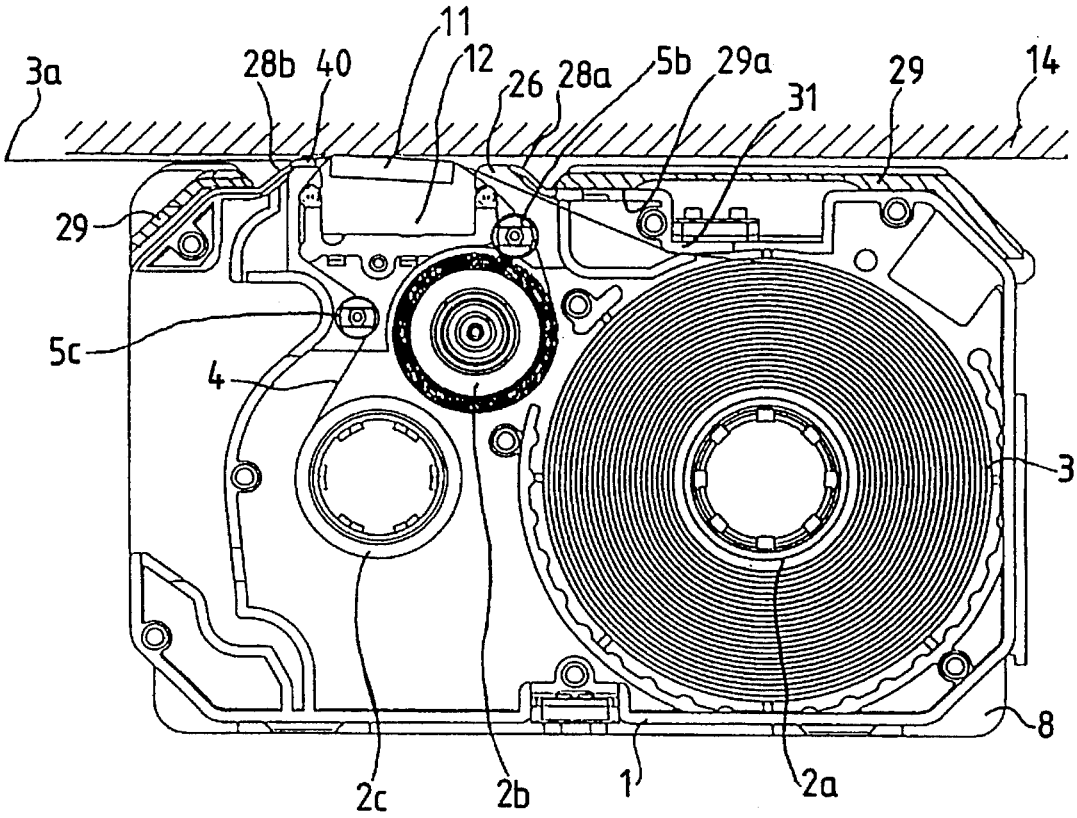
FIGS. 23 (*a*) and 23 (*b*) are diagrams showing the state that a print operation is executed by mounting the label creation cassette shown in FIG. 22 on the carriage of a thermal transfer printer, wherein FIG. 23 (*a*) is a plan view of the main portion of the label creation cassette and FIG. 23 (*b*) is a cross sectional view of the main portion thereof.
Figure 23B:
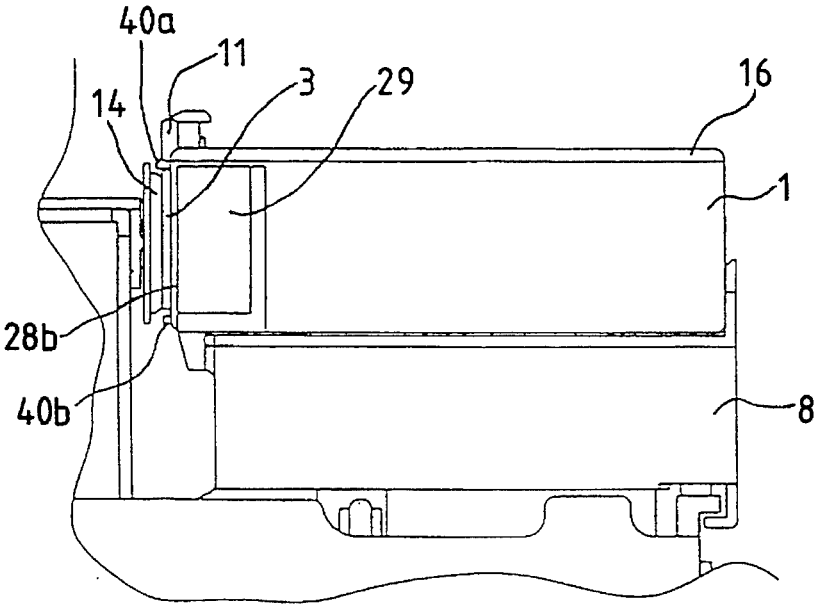

FIGS. 23*a*, 23*b* are diagrams showing the state that the print operation is executed with the label creation cassette of this embodiment mounted on the carriage 8 of the thermal transfer printer 7, wherein FIG. 23 (*a*) is a plan view thereof and FIG. 23 (*b*) is a side view thereof.

As shown in the figures, the projections 28*a* and 28*b* of the cassette case 1 are located nearer to the platen 14 side than the inner side surface 29*b* of the paper guide 29 provided with the carriage 8 also in this embodiment so that the label creation cassette can be smoothly mounted on the carriage as well as the image transfer tape 3 can be securely pressed against the platen 14 by a thermal head 11 when the print operation is executed to thereby enable the image transfer tape 3 to be securely drawn out from the cassette case 1.

Further, the image transfer tape 3 to which the print operation has been completed is guided substantially in parallel with the platen 14 as it is while the width direction of the image transfer tape 3 is guided by the guide member 40 disposed at the extreme end of the projection 28*b*. The guide member 40 of this embodiment is composed of a pair of guide members 40*a*, 40*b*. As shown in FIG. 23 (*b*), the guide members 40*a*, 40*b* project from the upper side and lower side of the cassette case 1 toward the platen 14 side and the width direction of image transfer tape 3 to which the print operation has been completed is guided by this pair of the guide members 40*a*, 40*b*.

According to this embodiment, since the cassette case 1 is not provided with the accommodation unit for accommodating the image transfer tape 3 to which the print operation has been completed, the structure of the cassette itself can be simplified as well as the image transfer tape 3 to which the print operation has been completed is stably transferred without being obliquely moved because the width direction thereof is guided by this pair of the guide members 40*a*, 40*b*.

Figure 24:
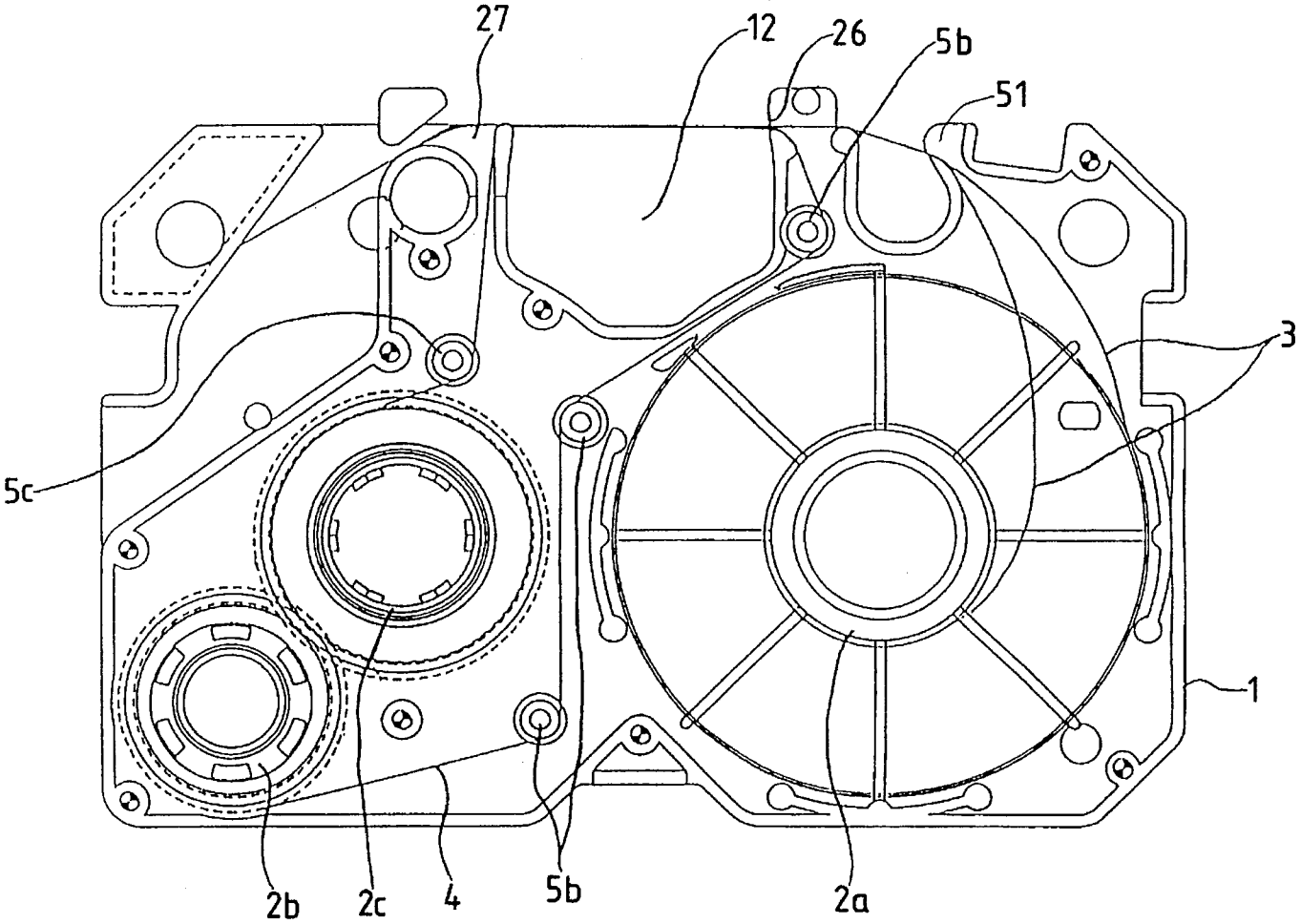
FIG. 24 is a plan view of the main portion of a fourth embodiment of the label creation cassette of the present invention.

Next, FIG. 24 shows a fourth embodiment of the label creation cassette of the present invention.

The label creation cassette of this embodiment has fundamentally the same arrangement as that of the aforesaid second embodiment, although the configuration of a cassette case 1, the location of an ink ribbon supply core 2*b*, and the like are different from those of the second embodiment. However, the feed path from the supply core of an image transfer tape 3 to a print unit is not arranged linearly but characterized by being formed to a substantially smooth curved shape with a projection directed toward only one side thereof. Further, the cassette case 1 includes a taking-out port 51 formed thereto independently of an opening 26 for taking out an ink ribbon 4 accommodated in the case 1 to the outside of the case. The taking-out port 51 is used to take out the image transfer tape 3 accommodated in the case 1 to the outside thereof and located on the upstream side of the opening 26 in the direction toward which the image transfer tape 3 is fed.

According to the label creation cassette of this embodiment, since the feed path of the image transfer tape 3 from the supply core 2a to the print unit is arranged as described above, a load for pulling out the image transfer tape 3 is reduced in a print operation, and thus the image transfer tape 3 is stably pulled out at all times in the print operation so that a high printing quality can be realized.

Figure 25A:
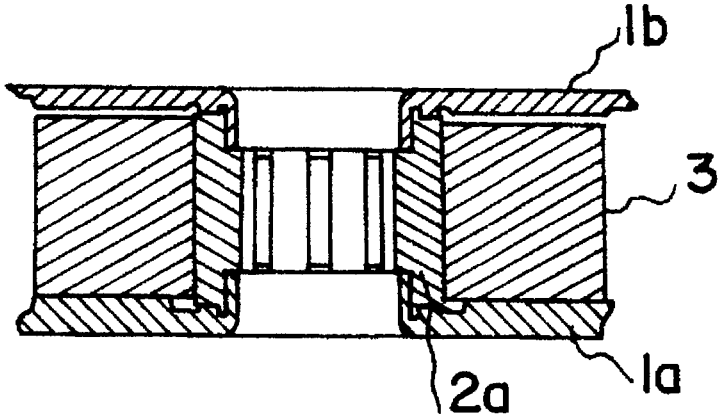
FIGS. 25 (*a*), 25 (*b*) and 25 (*c*) are cross sectional views of the main portion showing the arrangement of an image transfer tape supply core in the label creation cassette of the present invention.
Figure 25B:
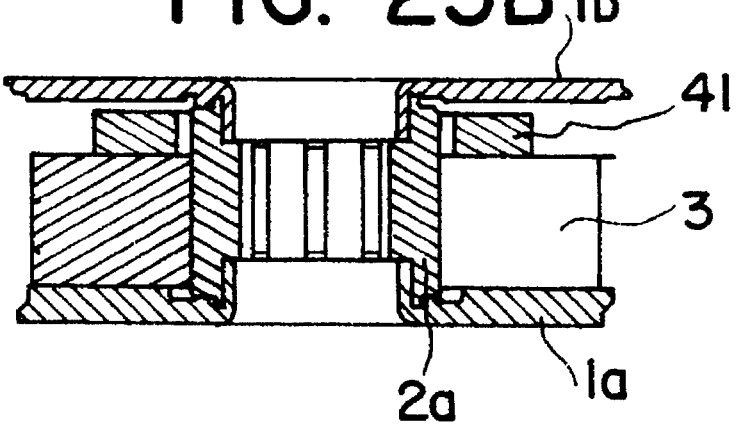
Figure 25C:
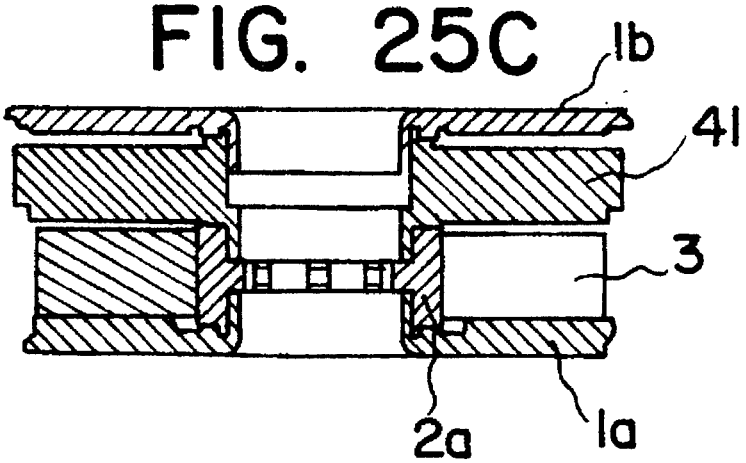

Next, FIG. 25 shows the arrangement of the supply core 2a of the image transfer tape 3 in the label creation cassette of the present invention.

The image transfer tape 3 used in the label creation cassette of the present invention has a plurality of kinds of widths such as, for example, 6 mm, 9 mm, 12 mm and the like. On the other hand, the cassette case of an ink ribbon cassette has not always a width corresponding to the width of the image transfer tape 3 from the restriction that the cassette case is mounted on the carriage of a thermal transfer printer used as a usual printer. Therefore, when the width of the image transfer tape 3 substantially coincides with the thickness of the cassette case 1 as shown in FIG. 25 (*a*), the image transfer tape 3 wound around the supply core 2a does not cause a winding disturbance in the width direction thereof because the motion of the image transfer tape 3 is regulated by the inner surfaces of upper and lower side cassette cases 1a, 1b. When, however, the image transfer tape 3 has a width smaller than the width of the cassette case 1, the image transfer tape 3 may cause the winding disturbance in the width direction thereof due to the vibration of the ink ribbon cassette in the upward and downward directions thereof produced when it is transported depending upon the stiffness of the image transfer tape 3 itself. Therefore, in this case, a disk-shaped spacer 41 is disposed between the upper surface of the image transfer tape 3 wound around the supply core and the upper side cassette case 1b as shown in FIGS. 25 (*b*) and (*c*) so that the winding disturbance of the image transfer tape 3 is prevented by regulating the motion of the image transfer tape 3 in the width direction thereof.

Next, a fifth embodiment of the present invention will be described with reference to FIGS. 26 and 27. In this embodiment, a cassette case 1 accommodates only a label tape 42 with a so-called thermo-sensitive recording layer which produces colors by the action of heat in place of accommodating both an image transfer tape 3 and an ink ribbon 4, and a desired label is created by executing a print operation by causing a thermal head to directly come into contact with the label tape 42 to produce desired colors.

Figure 26:
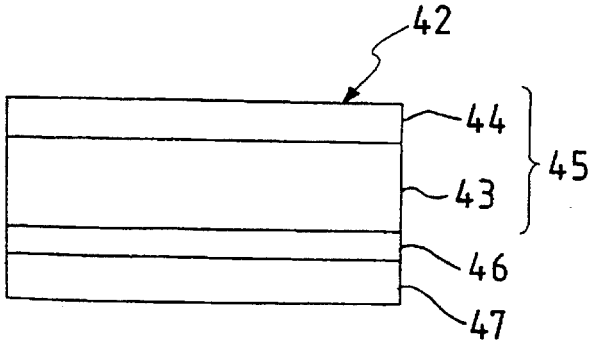
FIG. 26 is a diagram explaining the arrangement of a label tape having a thermo-sensitive recording layer used in a fifth embodiment of the label creation cassette of the preset invention.

FIG. 26 shows the arrangement of the label tape used in this embodiment and the label tape 42 is arranged in such a manner that a label sheet 45 having a thermo-sensitive layer 44 disposed on a substrate 43 is adhered to a release paper 47 through an adhesive layer 46.

Figure 27:
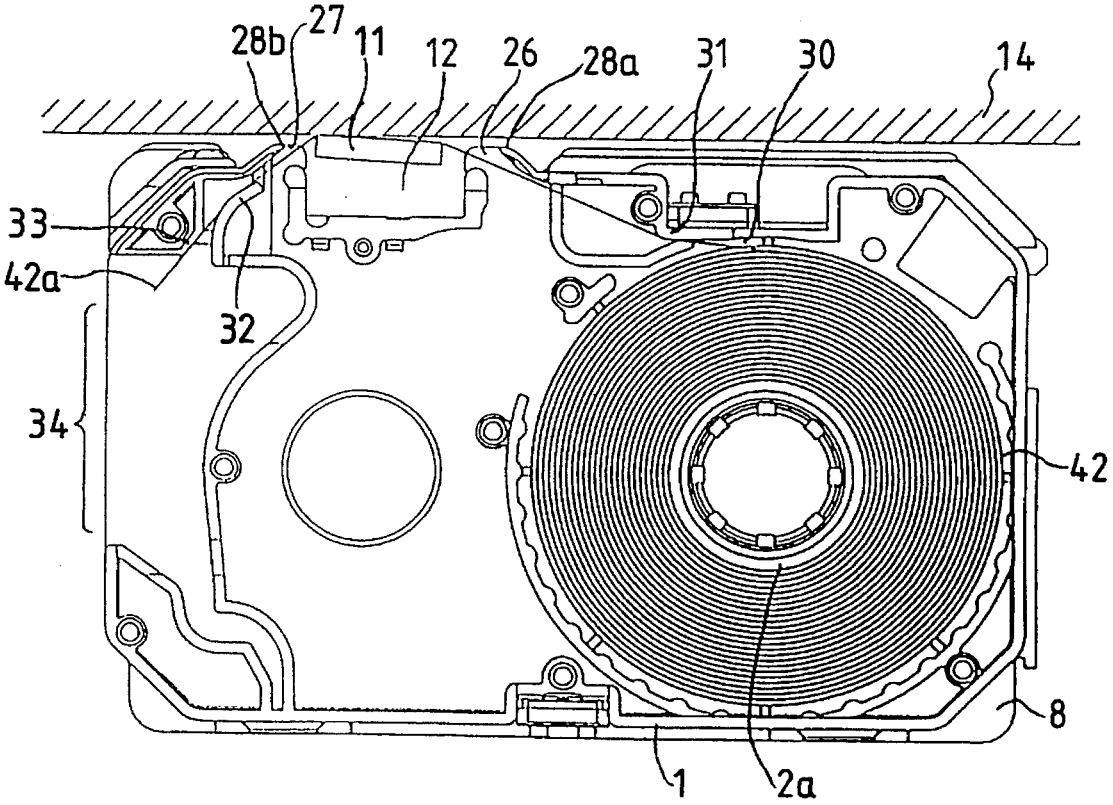
FIG. 27 is a plan view showing the main portion of the fifth embodiment of the label creation cassette of the present invention.

FIG. 27 shows the state that a print operation is executed to the label tape 42 with the label creation cassette of this embodiment mounted on the carriage 8 of a thermal transfer printer. The arrangement of the cassette itself is substantially the same as that of the second embodiment except that the ink ribbon 4 is not accommodated in the cassette tape 1. Note, the same numerals as used in the second embodiment are used to denote the same parts and the description thereof is omitted.

In this embodiment, the label tape 42 having the thermo-sensitive layer with the arrangement shown in FIG. 26 is wound around the supply core 2b of the image transfer tape and accommodated with the surface on the thermo-sensitive layer side thereof confronting with the heat generating unit of the thermal head. The label tape 42 is taken out once from the opening 26 formed to the recessed portion 12 in which the thermal head 11 is disposed and pressed against a platen 14 by the thermal head 11. Then, the thermo-sensitive layer 44 produces colors and executes a desired print operation by selectively supplying heat by the thermal head 11 while the carriage 8 is moved along the platen 14 in this state. The label tape 42 to which the print operation has been completed is introduced again into the cassette case 1 from the opening 27 formed to the recessed portion 12 and guided toward a direction apart from the platen 14 by a guide portion 13 and guide walls 32, 33 and then reaches the opening 34 formed to the side surface of the cassette case 1 and taken out to the outside of the cassette case 1 therefrom.

Further, the label tape 42 in this embodiment has a thickness larger than that of the image transfer tape 3 used in the aforesaid respective embodiments because it is provided with the thermo-sensitive layer 44. However, the label tape 42 is accommodated in the cassette case 1 in such a manner that it is abutted against the wall 31 formed to the cassette case 1 between the position 30 from which the label tape 42 is supplied from a supply core 2a and the opening 26 formed to the recessed portion 12 to take out the label tape 42 to the outside of the cassette case 1 therethrough so that the feed path of label tape 42 is substantially linearly arranged therebetween, similarly to the aforesaid second embodiment, and thus a load for drawing out the label tape 42 is reduced. As a result, the label tape 42 can be stably drawn out at all times in a print operation.

According to this embodiment, an ink ribbon is not needed when a label is created and an ink ribbon cassette for creating the label can be made at a low cost with a simple structure.

Next, a sixth embodiment of the present invention will be described with reference to FIGS. 28, 29 and 30.

Figure 28:
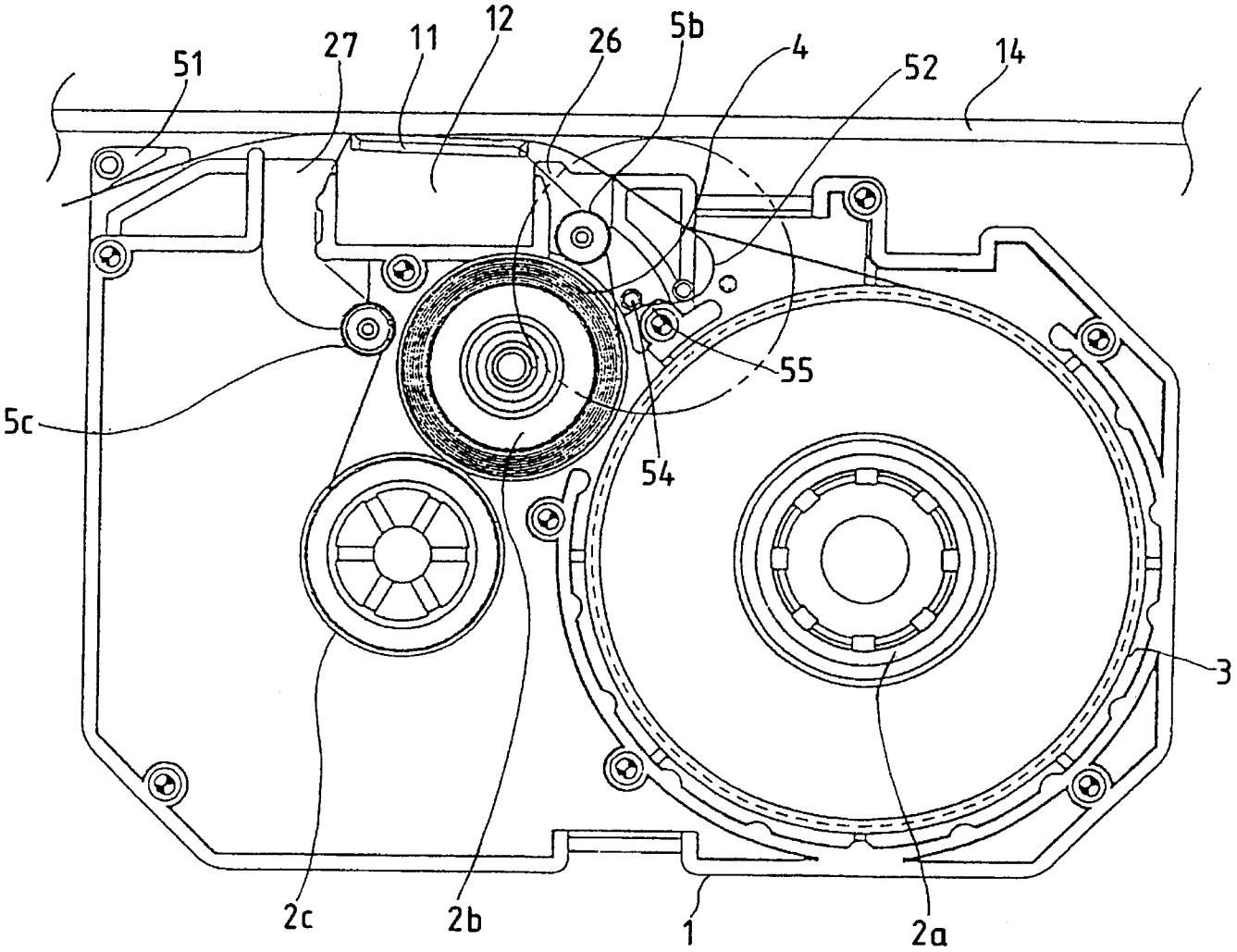
FIG. 28 is a plan view showing a sixth embodiment of the label creation cassette of the present invention.
Figure 29:
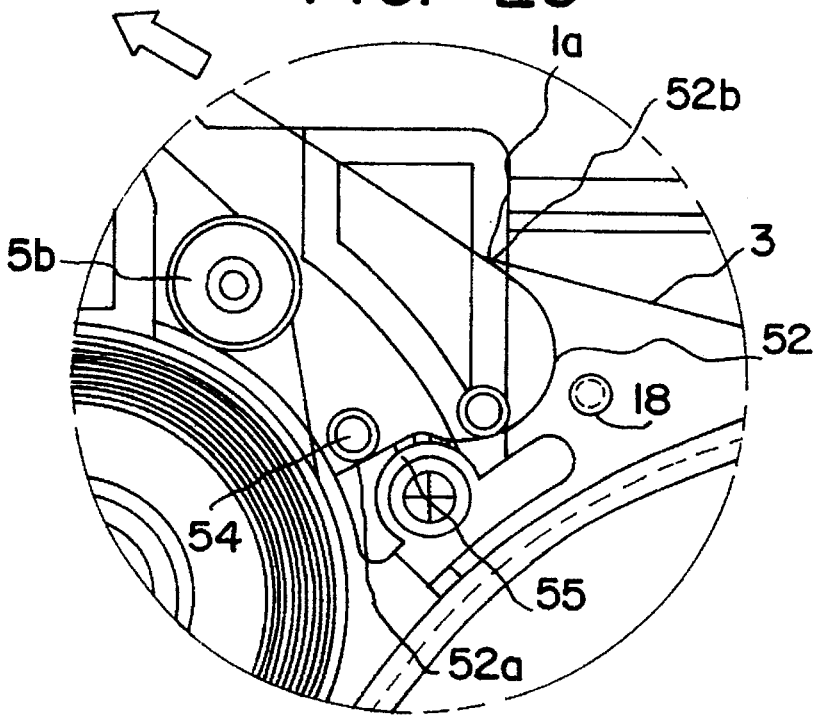
FIG. 29 is an enlarged view of the main portion showing the state of a rewinding prevention member used in a print operation in the label creation cassette shown in FIG. 28.
Figure 30:
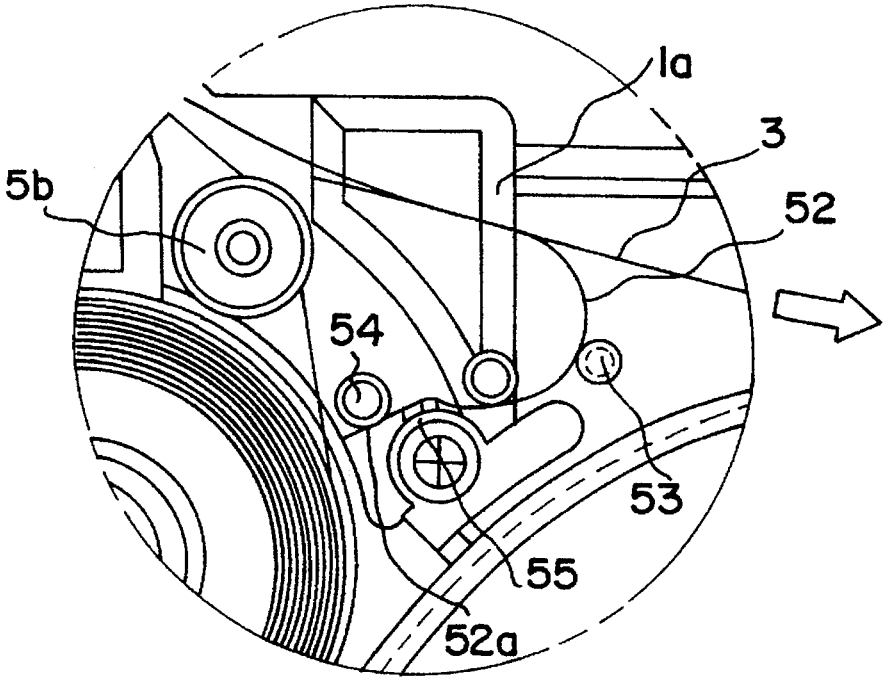
FIG. 30 is an enlarged diagram of the main portion showing the state of the rewinding prevention member when an image transfer tape has been rewound in the label creation cassette shown FIG. 28.

FIG. 28 is a plan view of the main portion of a label creation cassette of this embodiment and FIGS. 29 and 30 are enlarged views of the main portion of the vicinity of a head. The same numerals as used in the aforesaid respective embodiments are used to denote the same parts and the description thereof is omitted.

As shown in FIG. 28, an ink ribbon cassette of this embodiment is arranged such that an image transfer tape 3 as a label tape onto which images and the like are thermally transferred is wound in a cassette case 1 with a substantially rectangular surface and the image transfer tape 3 and an ink ribbon 4 are overlapped to each other and disposed between the platen 14 and the thermal head 11 of a thermal transfer printer 7 between the openings 26 and 27 formed to a recessed portion 12. Thus, the ink of the ink ribbon 4 is thermally transferred to the image transfer tape 3 by the thermal head 11 at this position so that a so-called print operation is executed.

The image transfer tape 3 to which the print operation has been completed is guided toward a direction apart from the platen 14 by a guide 51 located on the downstream side of the print position and further spaced apart from the opening 27, taken out to the outside of the cassette case 1 and cut to a necessary length to complete the creation of the label.

Further, a rewind prevention member 52 is provided in the vicinity of the opening 26 of the recessed portion 12 from which the image transfer tape 3 is drawn out to prevent the image transfer tape 3 from being rewound also as shown in FIGS. 29 and 30. The rewind prevention member 52 is composed of a flexible thin member with a thickness of about 0.03–0.05 mm of polyethylene or the like. As shown in the figure, the rewind prevention member 52 has an end 52a fixed between a pair of support portions 54, 55 and the other curved end 52*b* disposed to hold the image transfer tape 3 between it and the outer wall 1*a* of the ribbon cassette case 1.

When a print operation is started, the image transfer tape 3 is drawn out in the direction of the arrow shown in FIG. 29, but at this time, almost any load is not applied to the image transfer tape 3. When the image transfer tape 3 tends to be rewound as shown in FIG. 30, however, the rewind prevention member 52 in also pulled as the image transfer tape moves. As a result, since a force acts to press the image transfer tape 3 against the outer wall 1*a* of the ribbon cassette case 1, the image transfer tape 3 is prevented from being pulled into the ribbon cassette case 1. Further, a stopper 53 is provided to prevent the rewind prevention member 52 from being unnecessarily pulled into the ribbon cassette case 1.

According to this embodiment, since the label creation cassette is arranged as described above, even if the thermal printer having a weak pressing pressure for pressing the thermal head 11 against the platen 14 can create a label without characters becoming blurred, and moreover, the ribbon cassette is prevented from entering the ribbon cassette.

As described above, according to the present invention, since the label creation cassette is arranged as described above, a print operation can be stably executed to a label with the label creation cassette mounted on a thermal printer such as a thermal transfer printer and the like usually employed mainly as an output unit of wordprocessors or personal computers without the need of a dedicated label creation unit, and thus the label can be simply created by using the printer used for executing a print operation to usual papers.

What is claimed is:

1. A label creation cassette for mounting on a thermal printer, the thermal printer including a thermal head for generating thermal energy, the label creation cassette comprising:

a case;

an image transfer tape mounted in the case;

a thermal transfer ink ribbon mounted in the case and having ink which is selectively transferred to the image transfer tape upon generation of the thermal energy by the thermal head during a print operation;

an accommodation unit formed in the case for accommodating at least a portion of said image transfer tape to which the print operation has been executed by the thermal head; and a holding unit provided with said accommodation unit for holding a leading end of said portion of said image transfer tape introduced into said accommodation unit.

2. A label creation cassette according to claim 1, further comprising a guide path formed for guiding said portion of said image transfer tape into said accommodation unit.

3. A label creation cassette according to claim 1, comprising a guide member for guiding the leading end of said portion of said image transfer tape into said holding unit.

4. A label creation cassette according to claim 1, comprising a second opening formed in an upper surface of said cassette for exposing said portion of said image transfer tape accommodated in said accommodation unit.

5. A label creation cassette for mounting on a thermal printer, the thermal printer including a thermal head for generating thermal energy, the label creation cassette comprising:

a case;

an image transfer tape mounted in the case;

a thermal transfer ink ribbon mounted in the case and having ink which is selectively transferred to the image transfer tape upon generation of the thermal energy by the thermal head during a print operation;

an accommodation unit formed in the case for accommodating at least a portion of said image transfer tape to which the print operation has been executed by the thermal head; and a holding unit for holding a leading end of said portion of said image transfer tape and a first opening for taking out said image transfer tape held by said holding unit therethrough while curving a trailing end of said portion of said image transfer tape.

6. A label creation cassette according to claim 5, further comprising a guide path formed for guiding said portion of said image transfer tape into said accommodation unit.

7. A label creation cassette according to claim 5, comprising a guide member for guiding the leading end of said portion of said image transfer tape into said holding unit.

8. A label creation cassette according to claim 5, comprising a second opening formed in an upper surface of said cassette for exposing said portion of said image transfer tape accommodated in said accommodation unit.

* * * * *